US007608376B2

(12) United States Patent
Miura et al.

(10) Patent No.: US 7,608,376 B2
(45) Date of Patent: Oct. 27, 2009

(54) METHOD OF MANUFACTURING LIQUID DEVELOPER, LIQUID DEVELOPER, AND IMAGE FORMING APPARATUS

(75) Inventors: Satoru Miura, Matsumoto (JP); Hiroshi Kaiho, Matsumoto (JP); Takashi Teshima, Shiojiri (JP); Koji Akioka, Matsumoto (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 325 days.

(21) Appl. No.: 11/677,964

(22) Filed: Feb. 22, 2007

(65) Prior Publication Data

US 2007/0202431 A1 Aug. 30, 2007

(30) Foreign Application Priority Data

Feb. 24, 2006 (JP) ..... 2006-049230
Oct. 18, 2006 (JP) ..... 2006-284317

(51) Int. Cl.
*G03G 9/12* (2006.01)

(52) U.S. Cl. ..... 430/115; 430/137.22

(58) Field of Classification Search ..... 430/115, 430/137.22

See application file for complete search history.

(56) References Cited

U.S. PATENT DOCUMENTS 6,255,363 B1 * 7/2001 Baker et al. ..... 430/115
6,815,136 B1 * 11/2004 Zhao et al. ..... 430/117.32
2006/0234150 A1 * 10/2006 Akioka et al. ..... 430/112

FOREIGN PATENT DOCUMENTS

JP 08-007470 1/1996
JP 08-036277 2/1996

* cited by examiner

*Primary Examiner*—John L Goodrow
(74) *Attorney, Agent, or Firm*—Hogan & Hartson LLP

(57) ABSTRACT

A method of manufacturing a liquid developer includes associating fine particles mainly containing a resin material so as to obtain associated particles, and disintegrating the associated particles in an insulation liquid so as to obtain toner particles.

14 Claims, 2 Drawing Sheets

METHOD OF MANUFACTURING LIQUID DEVELOPER, LIQUID DEVELOPER, AND IMAGE FORMING APPARATUS

BACKGROUND

1. Technical Field

The present invention relates to a method of manufacturing a liquid developer, a liquid developer, and an image forming apparatus.

2. Related Art

As a developer for developing an electrostatic latent image formed on a latent image carrier, there are known two types of a dry toner that is formed of a material containing a colorant, such as a pigment or the like, and binder resin and is used in a dry condition thereof, and a liquid developer that is obtained by dispersing toner particles into a carrier liquid having electric insulation properties.

The dry toner is generally manufactured by a dry milling method that mills a material containing a colorant and a binder resin in a dry condition. In such a dry toner, since the solid state toner is handled, there is an advantage in handleability thereof. Meanwhile, there are many problems in view of an adverse affect of toner powder on a human body, contamination by dispersion of toner, and uniformity when the toner is dispersed. Further, in such a dry toner, since aggregation of toner particles is likely to occur upon preservation or the like, it is difficult to obtain toner particles each having a sufficiently small size. Further, it is difficult to form a toner image with high resolution. In addition, when the sizes of the toner particles are comparatively small, the above problems by the toner powder drastically appear.

Meanwhile, in the liquid developer, since an insulating liquid is used as a medium, the problem, such as aggregation of toner particles in the liquid developer upon preservation rarely occurs, compared with the dry toner, and thus fine toner particles can be used. As a result, the liquid developer has such advantages as good reproducibility of an image having thin lines, good gray-scale reproducibility, and excellent color reproducibility, compared with the dry toner. Further, the liquid developer is also superior as a method of forming an image at high speed.

As a method of manufacturing such a liquid developer, in JP-A-8-36277, there is disclosed a wet milling method that mills a material containing a colorant and a resin in an electric insulation liquid to thereby manufacture a liquid developer. Further, in JP-B-8-7470, there is disclosed a polymerization method that polymerizes monomer ingredients in the electric insulation liquid to thereby form resin particles insoluble to the electric insulation liquid.

However, a known method of manufacturing a liquid developer suffers from the following problems.

That is, in the wet milling method, it is difficult to mill toner particles to have a sufficiently small size. Further, since it takes much time and considerable energy for milling to obtain the toner particles each having a sufficiently small size, productivity of the liquid developer is drastically degraded. Further, in the above-described method, the particle size distribution of the toner particles is likely to be widened (a variation in particle size is large) As a result, a variation in characteristic between the toner particles (for example, charging property or the like) is likely to be increased. Meanwhile, although the above-described dry milling method can be considered, in this case, it is difficult to obtain fine particles required for the toner particles of the liquid developer. In addition, since aggregation is likely to proceed, it is difficult to obtain comparatively small toner particles.

Further, in the polymerization method, it is difficult to establish an appropriate polymerization reaction condition. Accordingly, it is difficult to generate a resin material having an appropriate molar weight, to form toner particles each having a desired size, or to sufficiently reduce a variation in size between the toner particles. As a result, quality stability and reliability of the toner, such as charging property or the like, is likely to be degraded. Further, in the polymerization method, it takes comparatively long time to form toner particles, and thus productivity of the liquid developer deteriorates. In addition, in the polymerization method, large production apparatuses and large production equipment are generally needed.

Further, in the known methods described above, it is difficult to obtain a liquid developer in which dispersibility of the toner particles is sufficiently high. If dispersibility of the toner particles is bad, when the toner particles are left for a long time, the toner particles may be subsided, and aggregation of the toner particles may occur. Further, once if the toner particles are subsided and aggregation occurs, even though the toner particles are stirred again and dispersed, it is difficult to disperse the toner particles. Accordingly, upon image forming, the toner particles cannot be uniformly supplied.

SUMMARY

An advantage of some aspects of the invention is that it provides a liquid developer in which toner particles each having a sufficiently small size are stably dispersed, a method of manufacturing a liquid developer capable of efficiently manufacturing a liquid developer in which toner particles each having a sufficiently small size are stably dispersed, and an image forming apparatus capable of forming a high-definition toner image with high resolution without causing thin spot and irregularity.

The advantage can be achieved by the following aspects of the invention.

According to a first aspect of the invention, a method of manufacturing a liquid developer includes associating fine particles mainly containing a resin material so as to obtain associated particles, and disintegrating associated particles in an insulation liquid so as to obtain toner particles.

In the method of manufacturing a liquid developer according to the first aspect of the invention, upon disintegration, a dispersant may be added to the insulation liquid.

In the method of manufacturing a liquid developer according to the first aspect of the invention, when electrical resistance of the liquid developer A [Ωcm] and electrical resistance of the insulation liquid is B [Ωcm] the relationship $0.04 \leqq A/B \leqq 0.3$ may be satisfied.

In the method of manufacturing a liquid developer according to the first aspect of the invention, the content of the dispersant in the liquid developer may be 0.10 to 3.0 wt %.

In the method of manufacturing a liquid developer according to the first aspect of the invention, the dispersant may be a polymer dispersant.

In the method of manufacturing a liquid developer according to the first aspect of the invention, when the content of the dispersant in the liquid developer is C [wt %] and the content of the toner particles is D [wt %], the relationship $0.006 \leqq C/D \leqq 0.12$ may be satisfied.

In the method of manufacturing a liquid developer according to the first aspect of the invention, the insulation liquid used for disintegration may contain fatty acid monoester.

In the method of manufacturing a liquid developer according to the first aspect of the invention, the insulation liquid used for disintegration may contain medium-chain fatty acid ester.

In the method of manufacturing a liquid developer according to the first aspect of the invention, the medium-chain fatty acid ester may be ester of medium-chain fatty acid and glycerine.

In the method of manufacturing a liquid developer according to the first aspect of the invention, the insulation liquid used for disintegration may contain low-viscosity paraffin oil.

In the method of manufacturing a liquid developer according to the first aspect of the invention, viscosity of the insulation liquid used for disintegration may be 1000 mPa·s or less.

In the method of manufacturing a liquid developer according to the first aspect of the invention, interfacial tension of the insulation liquid used for disintegration with respect to the resin material may be 35 mN/m or less.

In the method of manufacturing a liquid developer according to the first aspect of the invention, the resin material may be polyester resin.

According to a second aspect of the invention, there is provided a liquid developer that is manufactured by a manufacturing method including associating fine particles mainly containing a resin material so as to obtain associated particles, and disintegrating the associated particles in an insulation liquid so as to obtain toner particles.

According to a second aspect of the invention, an image forming apparatus includes a liquid developer storage unit that stores a liquid developer, a developing unit that develops using the liquid developer supplied from the liquid developer storage unit, a transfer unit that transfers an image formed on the developing unit so as to form a transfer image on the recording medium, and a fixing unit that fixes the transfer image formed on the recording medium onto the recording medium. The liquid developer is manufactured by a manufacturing method that includes associating fine particles mainly containing a resin material so as to obtain associated particles, and disintegrating the associated particles in an insulation liquid so as to obtain toner particles.

With this configuration, a liquid developer in which toner particles each having a sufficiently small size are stably dispersed can be provided. Further, a method of manufacturing a liquid developer that is capable of efficiently manufacturing a liquid developer, in which toner particles each having a sufficiently small size are stably dispersed, can be provided. In addition, an image forming apparatus that is capable of forming a high-definition toner image with high resolution without causing thin spot and irregularity can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
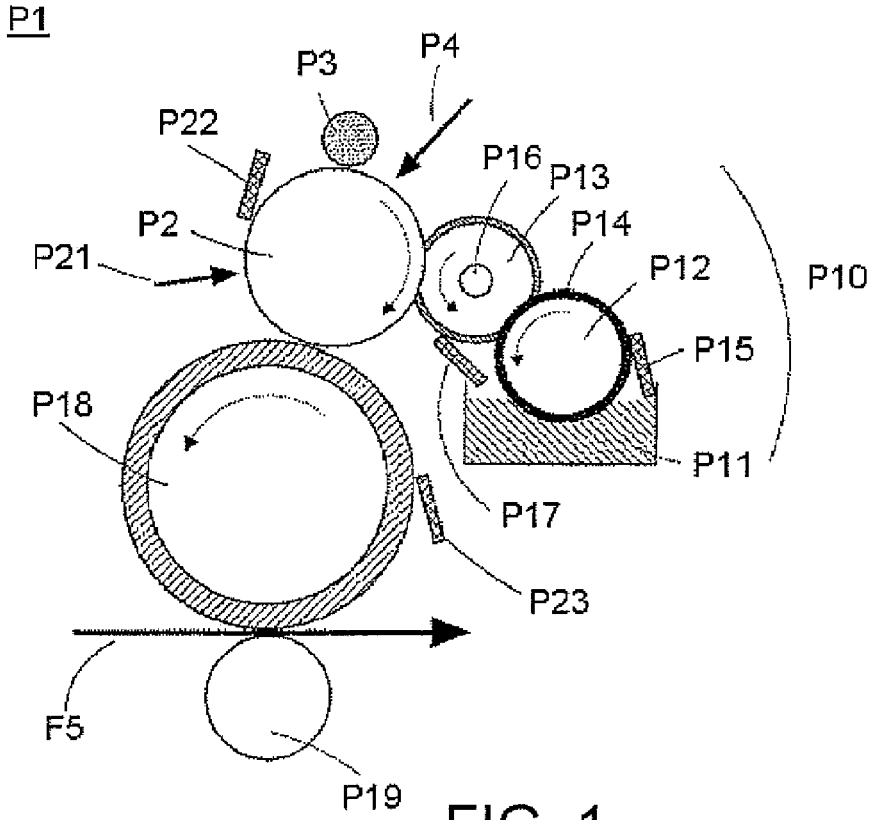
FIG. 1 is a cross-sectional view showing an example of a contact type liquid developing device that constitutes an image forming apparatus according to an embodiment of the invention.

Hereinafter, preferred embodiments of a method of manufacturing a liquid developer, and a liquid developer according to the invention will be described in detail.

First, a method of manufacturing a liquid developer according to an embodiment of the invention will be described.

A method of manufacturing a liquid developer according to an embodiment of the invention includes an associated particle forming step of associating fine resin particles mainly containing a resin material so as to obtain associated particles, and a step of disintegrating the associated particles in an insulation liquid so as to obtain toner particles.

Preparation of Associated Particle

First, an example of a method of preparing associated particles that associates fine resin particles mainly containing a resin material will be described.

For preparation of the associated particles, various methods can be used. In this embodiment, a water-based emulsion in which a dispersoid (fine particles) mainly containing a resin material (toner constituent material) is dispersed in a water-based dispersion medium composed of a water-based liquid is obtained, and the dispersoid in the water-based emulsion is associated, thereby obtaining associated particles.

Water Based Emulsion

First, the water-based emulsion that is used in this embodiment will be described.

In a water-based emulsion that is obtained by a method of preparing a water-based emulsion described below, a dispersoid (fine particles) is finely dispersed in a water-based dispersion medium composed of a water-based liquid.

Water-Based Dispersion Medium (Water-Based Liquid)

A water-based dispersion medium is composed of a water-based liquid.

Herein, the term 'water-based liquid' means that it is composed of water and/or a liquid having excellent compatibility with water (for example, a liquid having solubility of 30 g more with respect to water 100 g at 25° C.) As such, the water-based liquid is composed of water and/or a liquid having excellent compatibility with water, but it is preferably mainly composed of water. In particular, the content of water is preferably 70 wt % or more, and more preferably, 90 wt % or more. If such a water-based liquid is used, for example, dispersibility of the dispersoid in the water-based dispersion medium can be increased, and the dispersoid in the water-based emulsion can have a comparatively small size and have less variation in size. As a result, the resultant toner particle in the liquid developer has less variation in size and shape between the particles, and has large circularity.

Further, the water-based dispersion medium (water-based liquid) preferably has low compatibility with a high-insulation liquid described below (for example, solubility of 0.01 g or less with respect to the high-insulation liquid 100 g at 25° C.). Accordingly, the shape of the dispersoid in a mixture described below that is obtained in a mixture preparation process described below can be appropriately maintained, and the shape of the resultant toner particle in the liquid developer can be made uniform.

Specific examples of the water-based liquid include, for example, water, alcohol-based solvents, such as methanol, ethanol, and propanol, ether-based solvents, such as 1,4-dioxane and tetrahydrofuran (THF), aromatic heterocyclic compound-based solvents, such as pyridine, pyrazine, and pyrrole, amide-based solvents, such as N,N-dimethylformamide (DMF) and N,N-dimethylacetamide (DMA), nitrile-based solvents, such as acetonitrile or the like, and aldehyde-based solvents, such as acetaldehyde or the like.

Dispersoid (Fine Particles)

The dispersoid includes ingredients forming the toner particles in the liquid developer, and are composed of at least a material mainly containing a resin or its precursor (hereinafter, collectively referred to as 'resin material'). As the precursor of the resin, for example, monomer, dimer, and oligomer of the resin can be exemplified.

Hereinafter, the constituent material for the dispersoid will be described.

1. Resin (Resin Material)

The dispersoid is composed of a material mainly containing a resin (binder resin).

In the invention, the resin (binder resin) is not particularly limited. Specific examples of the resin include, for example, styrene-based resins, such as polystyrene, poly-α-methylstyrene, chloropolystyrene, styrene-chlorostyrene copolymer, styrene-proplylene copolymer, styrene-butadiene copolymer, styrene-vinyl chloride copolymer, styrene-vinyl acetate copolymer, styrene-maleate copolymer, styrene-acrylate ester copolymer, styrene-methacrylate ester copolymer, styrene-acrylate ester-methacrylate ester copolymer, styrene-α-chloracrylate methyl copolymer, styrene-acrylonitrile-acrylate ester copolymer, and styrene-vinyl methyl ether copolymer, which are monomers or copolymers containing styrene or styrene substitute, polyester resin, epoxy resin, urethane-modified epoxy resin, silicone-modified epoxy resin, vinyl chloride resin, rosin-modified maleate resin, phenyl resin, polyethylene-based resin, polyproplylene, ionomer resin, polyurethane resin, silicone resin, ketone resin, ethylene-ethyl acrylate copolymer, xylene resin, polyvinyl butyral resin, terpene resin, phenol resin, and aliphatic or cycloaliphatic hydrocarbon resin, which can be used alone or in combination of two or more of them. Among these, the polyester resin has high compatibility with, for example, an insulation liquid described below. When the polyester resin is used as the resin material forming the toner particles, dispersibility of the toner particles in the liquid developer can be superior. Further, since the polyester resin has high transparency, when it is used as the binder resin, a color forming property of the resultant image can be increased. In addition, since a dispersant described below is likely to be stuck to the polyester resin, even though the liquid developer contains the dispersant, it is possible to cause the dispersant in the liquid developer to stick to the surfaces of the toner particles. For this reason, the dispersant in the insulation liquid released from the toner particle can be reduced, and thus electrical resistance of the liquid developer can be prevented from being decreased. As a result, the liquid developer has an excellent charging property.

While the softening temperature of the resin (resin material) is not particularly limited, it is preferably in a range of 50 to 130° C., more preferably, 50 to 120° C., and still more preferably, 60 to 115° C. Moreover, in this specification, the softening temperature indicates a softening start temperature that is defined by measurement conditions of a rate of temperature increase: 5° C./min and a die diameter 1.0 mm in an overhead type flow tester (manufactured by Shimadzu Corporation).

Moreover, as occasion demands, a curing agent may be added to the above-described resin.

2. Solvent

A solvent that dissolves at least a part of the ingredients of dispersoid may be added to the dispersoid. Accordingly, for example, flowability of the dispersoid in the water-based emulsion can be increased, and the dispersoid in the water-based emulsion can have a comparatively small size and less variation in size. As a result, the resultant toner particle in the liquid developer has less variation in size and shape between the particles, and also has large circularity.

Any solvent may be used insofar as it dissolves at least a part of the constituent ingredients of the dispersoid. Preferably, a solvent having a lower boiling point than the above-described water-based liquid is used. Accordingly, the solvent can be easily removed.

Further, a solvent having low compatibility with the above-described water-based dispersion medium (water-based liquid) (for example, a solvent having solubility of 30 g or less with respect to the water-based dispersion medium 100 g at 25° C.) is preferably used. Accordingly, the dispersoid can be finely dispersed in the water-based emulsion stably.

In addition, the composition of the solvent can be appropriately selected according to, for example, the compositions of the above-described resin and colorant, or the composition of the water-based dispersion medium.

Examples of the solvent include inorganic solvents, such as carbon disulfide and carbon tetrachloride, or organic solvents, for example, ketone-based solvents, such as methyl ethyl ketone (MEK), acetone, diethyl ketone, methyl isobutyl ketone (MIEK), methyl isopropyl ketone (MIPK), cyclohexanone, 3-heptanone, and 4-heptanone, alcohol-based solvent, such as methanol, ethanol, n-propanol, isopropanol, n-butanol, i-butanol, t-butanol, 3-methyl-1-butanol, 1-pentanol, 2-pentanol, n-hexanol, cyclohexanol, 1-heptanol, 1-octanol, 2-octanol, 2-methoxyethanol, allylalcohol, furfuryl alcohol, and phenol, ether-based solvents, such as diethyl ether, dipropyl ether, diisopropyl ether, dibutyl ether, 1,2-dimethoxyethane (DME), 1,4-dioxane, tetrahydrofuran (THF), tetrahydropyran (THP), anisole, diethylene glycol dimethyl ether (diglyme), and 2-methoxyethanol, cellosolve-based solvents, such as methyl cellosolve, ethyl cellosolve, and phenyl cellosolve, aliphatic hydrocarbon-based solvents, such as hexane, pentane, heptane, cyclohexane, methyl cyclohexane, octane, didecane, methylcyclohexene, and isoprene, aromatic hydrocarbon-based solvents, such as toluene, xylene, benzene, ethylbenzene, and naphthalene, aromatic heterocyclic compound-based solvents, such as pyridine, pyrazine, furan, pyrrole, thiophene, 2-methyl pyridine, 3-methyl pyridine, 4-methyl pyridine, and furfuryl alcohol, amide-based solvents, such as N,N-dimethylformamide (DMF) and N,N-dimethylacetamide (DMA), halogenated compound-based solvents, such as dichloromethane, chloroform, 1,2-dichloroethane, trichloroethylene, and chlorobenzene, ester-based solvents, such as acetylacetone, ethyl acetate, methyl acetate, isopropyl acetate, isobutyl acetate, isopentylacetate, ethyl chloroacetate, butyl chloroacetate, isobutyl chloroacetate, ethyl formate, isobutyl formate, ethyl acrylate, methyl methacrylate, and ethyl benzonate, amine-based solvents, such as trimethyl amine, hexyl amine, triethyl amine, and aniline, nitrile-based solvents, such as acrylonitrile, acetonitrile, nitro-based solvents, nitromethane and nitroethane, and aldehyde-based solvents, such as acetoaldehyde, propione aldehyde, butyl aldehyde, pentanal, and acrylaldehyde. One from the solvents or two or more of them in admixture can be used.

The dispersoid usually contains a colorant. For the colorant, for example, a pigment, a dye, or the like can be used. Examples of the pigment and the dye include, for example, carbon black, spirit black, lamp black (C.I. No. 77266), magnetite, titanium black, chrome yellow, cadmium yellow, mineral fast yellow, navel yellow, naphthol yellow S, Hanza yellow G, permanent yellow NCG, chromium yellow, benzidine yellow, quinoline yellow, tartrazine lake, chrome orange, molybdenum orange, permanent orange GTR, pyrazolone orange, benzidine orange G, cadmium red, permanent red 4R, watching red calcium salt, eosin lake, brilliant carmine 3B, manganese violet, fast violet B, methyl violet lake, iron blue, cobalt blue, alkali blue lake, Victoria blue lake, fast sky blue, indanthrene blue BC, ultramarine blue, aniline blue, phthalocyanine blue, chalco oil blue, chrome green, chromium oxide, pigment green B, malachite green lake, phthalocyanine green, final yellow green G, rhodamine 6G, quinacridone, rose Bengal (C.I. No. 45432), C.I. direct red 1, C.I. direct red 4, C.I. acid red 1, C.I. basic red 1, C.I. mordant red 30, C.I. pigment red 48:1, C.I. pigment red 57:1, C.I. pigment red 122, C.I. pigment red 184, C.I. direct blue 1, C.I. direct blue 2, C.I. acid blue 9, C.I. acid blue 15, C.I. basic blue 3, C.I. basic blue 5, C.I. mordant blue 7, C.I. pigment blue 15:1, C.I. pigment blue 15:3, C.I. pigment blue 5:1, C.I. direct green 6, C.I. basic green 4, C.I. basic green 6, C.I. pigment yellow 17, C.I. pigment yellow 93, C.I. pigment yellow 97, C.I. pigment yellow 12, C.I. pigment yellow 180, C.I. pigment yellow 162, nigrosine dyes (C.I. No. 50415B), metal complex salt dyes, metal oxides, such as silica, aluminum oxide, magnetite, maghemite, various kinds of ferrites, cupric oxide, nickel oxide, zinc oxide, zirconium oxide, titanium oxide, and magnesium oxide, and magnetic materials containing magnetic metals, such as Fe, Co, and Ni, which can be used alone or in combination of two or more of them.

While the content of the colorant in the water-based emulsion is not particularly limited, but it is preferably in a range of 0.1 to 15 wt % and more preferably, 0.3 to 10 wt %. If the content of the colorant is less than the lower limit described above, there may be a difficulty in forming a visible image at a sufficient density depending on the kind of the colorant. Meanwhile, if the content of the colorant exceeds the upper limit described above, the fixing property or the charging property of the resultant toner can be degraded.

The dispersoid may also contain a wax. The wax is usually used to improve releasability. Examples of the wax include, for example, natural waxes, for example, plant waxes, such as candellila wax, carrnauba wax, rice wax, cotton wax, and Japan wax, animal waxes, such as bees wax and lanolin, mineral waxes, such as montan wax, ozokelite, and ceresin, petroleum waxes, such as paraffin wax, micro-wax, microcrystalline wax, and petrolactum, and synthesis waxes, for example, synthesis hydrocarbon waxes, such as Fischer Tropsch wax, polyethylene wax (polyethylene resin), polyproplylene wax (polyproplylene resin), oxidized type polyethylene wax, and oxidized type polyproplylene wax, fatty acid amides, such as 12-hydroxystearic acid amide, stearic acid amide, phthalic acid anhydride imide, and chlorinated hydrocarbon, esters, ketones, and ethers, which can be used alone or in combination of two or more of them. In addition, as the wax, a low-molecular-weight crystalline polymer resin may be used. For example, crystalline polymers having long alkyl groups on the side chain, for example, homopolymers or copolymers of polyacrylate, such as poly n-stearyl methacrylate and poly n-lauryl methacrylate (for example, copolymer with n-stearyl acrylate-ethyl methacrylate) can also be used.

While the content of the wax in the water-based emulsion is not particularly limited, it is preferably 1.0 wt % or less, and more preferably, 0.5 wt % or less. If the content of the wax is excessive, the wax is released from the resultant toner particle of the liquid developer and coarsened, which tends to degrade transfer efficiency of the toner.

While the softening temperature of the wax is not particularly limited, it is preferably in a range of 50 to 130° C., and more preferably, 50 to 120° C.

The water-based emulsion may contain other ingredients. For these ingredients, for example, emulsified dispersants, charge controllers, magnetic powder, and the like can be exemplified. Among these, when the emulsified dispersant is used, dispersibility of the dispersoid can be improved, and the shape and the variation in size of the dispersoid in the water-based emulsion can be comparatively easily made considerably small. In addition, the shape of the dispersoid can have substantially a spherical shape. As a result, the resultant liquid developer that is composed of the toner particles having substantially a spherical shape and the uniform shape and size can be obtained. Here, for the emulsified dispersant, for example, emulsifiers, dispersants, and dispersion aids may be exemplified.

Examples of the dispersant include, for example, inorganic dispersants, such as clay minerals, silica, and tricalcium phosphate, nonionic organic dispersants, such as polyvinyl alcohol, carboxymethyl cellulose, polyethylene glycol, and hydroxy stearic acid ester, anionic organic dispersants, such as tristearate metal salts (for example, aluminum salt), distearate metal salts (for example, aluminum salt and barium salt), stearate metal salt (for example, calcium salt, lead salt, and zinc salt), linolenate metal salts (for example, cobalt salt, manganese salt, lead salt, and zinc salt), octanoate metal salts (for example, aluminum salt, calcium salt, and cobalt salt) oleate metal salts (for example, calcium salt and cobalt salt), palmitate metal salts (for example, zinc salt), naphthenate metal salts (for example, calcium salt, cobalt salt, manganese salt, lead salt, and zinc salt), resinate metal salts (for example, calcium salt, cobalt salt, manganese lead salt, and zinc salt), polyacrylate metal salts (for example, sodium salt), polymethacrylate metal salts (for example, sodium salt), polymaleate metal salts (for example, sodium salt), acrylate-maleate copolymer metal salts (for example, sodium salt), and polystyrene sulfonate metal salts (for example, sodium salt), and cationic organic dispersant, such as quaternary ammonium salt. Among these, the nonionic organic dispersant or the anionic organic dispersant is preferably used.

While the content of the dispersant in the water-based emulsion is not particularly limited, it is preferably 3.0 wt % or less, and more particular, in a range of 0.01 to 1.0 wt %.

For the dispersion aid, for example, anionic, cationic, and nonionic surfactants can be exemplified.

The dispersion aid may also be used as the dispersant. When the water-based emulsion contains the dispersant, the content of the dispersion aid in the water-based emulsion is not particularly limited, but it is preferably 2.0 wt % or less, and more preferably, in a range of 0.005 to 0.5wt %.

Examples of the charge controller include, for example, metal salts of benzoic acid, metal salts of salicylic acid, metal salts of alkyl salicylic acid, metal salts of catechol, metal-containing bisazo dyes, nigrosine dyes, tetraphenyl borate derivatives, quaternary ammonium salts, aluminum stearate, alkyl pyridinium salts, chlorinated polyesters, nitrofumic acids.

Examples of the magnetic powder include, for example, metal oxides, such as magnetite, maghemite, various kinds of ferrites, cupric oxide, nickel oxide, zinc oxide, zirconium oxide, titanium oxide, and magnesium oxide, and magnetic materials containing magnetic metals, such as Fe, Co, and Ni.

Other materials other than the above-described materials, for example, zinc stearate, zinc oxide, and cerium oxide may be added to the water-based emulsion.

Other ingredients than the dispersoid may be dispersed as an insoluble component in the water-based emulsion. For example, fine inorganic powder, such as silica, titanium oxide, and iron oxide, and fine organic powder, such as fatty acid and fatty acid metal salt may be dispersed in the water-based emulsion.

In the above-described water-based emulsion that is used in the invention, since dispersoid is liquid, the dispersoid tends to become a shape having large circularity (sphericity) by surface tension. Accordingly, in the resultant toner particle for liquid development, circularity is considerably high, and a variation in shape between the particles becomes considerably small.

While the content of the dispersoid in the water-based emulsion is not particularly limited, it is preferably in a range of 5 to 55 wt %, and more preferably, 10 to 50 wt %. Accordingly, coupling (aggregation) of the dispersoids in the water-based emulsion can be reliably prevented, and superior productivity of the toner particles (liquid developer) can be achieved.

While the average particle size of the dispersoid (liquid dispersoid) in the water-based emulsion is not particularly limited, it is preferably in a range of 0.01 to 3 μm, and more preferably, 0.1 to 2 μm. Accordingly, the result toner particle having an appropriate size can be obtained. Moreover, in this specification, the term 'average particle size' means an average particle size based on the volume.

Water-Based Emulsion Preparation Process

The above-described water-based emulsion can be prepared, for example, in the following manner (water-based emulsion preparation process).

First, an aqueous solution in which, as occasion demands, a dispersant is added to the above-described water-based liquid is prepared.

Meanwhile, a resin solution containing a resin or its precursor (hereinafter, collectively referred to as 'resin material') as the main ingredient of the toner described above is prepared. In the preparation of the resin liquid, for example, the solvent described above may be used in addition to the resin material. Further, the resin liquid may be a molten liquid that is obtained by heating the resin material. In addition, in the preparation of the resin liquid, for example, a kneaded material that is obtained by kneading the materials for the toner, such as the resin material, the colorant, and the like may be used. If such a kneaded material is used, even though the constituent materials of the toner include ingredients that are rarely dispersed or compatible with each other, the individual ingredients in the resultant kneaded material can be sufficiently compatible with each other and finely dispersed through kneading. In particular, when a pigment (colorant) having a comparatively low dispersibility with respect to the above-described solvent is used, if kneading is performed in advance before the solvent is dispersed, the resin component and the like effectively coats around the pigment particles. Accordingly, dispersibility of the pigment in the solvent is improved (in particular, fine dispersion in the solvent is possible), and a good color forming property of the resultant toner is obtained. From this viewpoint, even though the constituent materials of the toner include components having low dispersibility with respect to the water-based dispersion medium of the above-described water-based emulsion or components having low solubility with respect to the solvent contained in the dispersion medium of the water-based emulsion, the dispersoid having excellent dispersibility in the water-based emulsion can be obtained.

Next, the resin liquid is gradually dropped and added to the aqueous solution in a stirred state, and then a water-based emulsion in which the dispersoid containing the resin material is dispersed in the water-based dispersion medium is obtained. By preparing the water-based emulsion in such a manner, circularity of the dispersoid in the water-based emulsion can be further increased. As a result, the resultant toner particles for liquid development have high circularity and less variation in shape between the particles. When the resin liquid is dropped, the aqueous solution and/or thee resin liquid may also be heated. Further, when the solvent is used in the preparation of the resin liquid, for example, at least a portion of the solvent contained in the dispersoid may be removed by heating the resultant water-based emulsion or placing the same under a reduced pressure atmosphere after the resin liquid is dropped.

As for the mixture of the resin liquid and the water-based liquid, a phase inversion emulsification may be performed by gradually adding (dropping) the water-based liquid to the colored resin liquid while applying a shear force to the resin liquid using a stirrer, and finally, a dispersion liquid in which a resin liquid-derived dispersoid is dispersed in the water-based liquid may be obtained. Accordingly, for example, a water-based emulsion in which the dispersoid is homogeneously and finely dispersed can be easily and reliably obtained.

Associated Particle Forming Process

Next, an electrolyte is added to the water-based emulsion obtained in the above-described manner, and the dispersoid is associated so as to form associated particles (associated particle forming process).

Examples of the additive electrolyte include, for example, acidic materials, such as hydrochloric acid, sulfuric acid, phosphoric acid, acetate, and oxalic acid, and organic and inorganic water-soluble salts, such as sodium sulfate, ammonium sulfate, potassium sulfate, magnesium sulfate, sodium phosphate, sodium dihydrogenphosphate, sodium chloride, potassium chloride, ammonium chloride, calcium chloride, and sodium acetate, which can be used alone or in combination of two or more of them. Among these, monovalent cationic sulfate salts, such as sodium sulfate and ammonium sulfate, can be appropriately used for uniform association.

Moreover, after the electrolyte and the like are added, an inorganic dispersion stabilizer, such as hydroxy apatite, or an ionic or nonionic surfactant can be used as the dispersion stabilizer. When the dispersion stabilizer (emulsifier) is used, if the electrolyte is added, ununiform association can be prevented.

Examples of the dispersion stabilizer include, for example, nonionic surfactants, such as polyoxyethylene nonylphenyl ether, polyoxyethylene octylphenyl ether, polyoxyethylene dodecylphenyl ether, polyoxyethylene alkyl ether, polyoxyethylene fatty acid ester, sorbitan fatty acid ester, polyoxyethylene sorbitan fatty acid ester, and various kinds of PLURONIC, alkyl sulfate ester salt type anionic surfactants, and quaternary ammonium salt type cationic surfactants. Among these, the anionic or nonionic surfactant is effective for dispersion stability even with a small additive amount. The cloud point of the nonionic surfactant that can be appropriately used is preferably 40° C. or more.

The additive amount of the electrolyte is preferably in a range of 0.5 to 15 parts by weight with respect to 100 parts by weight of the solid content in the water-based emulsion, more preferably, 1 to 12 parts by weight, and still more preferably, 1 to 10 parts by weight. If the additive amount of the electrolyte is less than the lower limit described above, association of the dispersoid may not sufficiently progress. Further, if the additive amount of the electrolyte exceeds the upper limit described above, association of the dispersoid may become ununiform, and coarse particles may be generated. Then, a variation in size between the resultant toner particles may occur.

Further, this process may be performed immediately after the water-based emulsion is prepared, or may be performed after the water-based emulsion is prepared and preserved. In the latter case, the preservation period is not particularly limited. If the preservation is six months or less, the particle size distribution of the resultant associated particles can be made narrow.

Next, after association, filtering and drying are performed, thereby obtaining the associated particles.

The average particle size of the resultant associated particles is preferably in a range of 1 to 10 μm, and more preferably, 1 to 7 μm. Accordingly, the particle size of the resultant toner particles can be made appropriately. Further, if the average particle size of the associated particles falls within the above-described range, drying can be easily performed, and upon drying, the associated particles can be prevented from aggregating and then coarsening.

Disintegration Process

Next, the associated particles obtained in the above-described manner are disintegrated in the insulation liquid forming the liquid developer (disintegration process) Accordingly, a liquid developer in which the toner particles are dispersed in the insulation liquid is obtained.

As such, the invention has a feature in that the resultant associated particles are disintegrated in the insulation liquid so as to form the toner particles. Accordingly, a liquid developer in which toner particles each having a sufficiently small size are stably dispersed can be provided.

More specifically, even though the toner particles each having a comparatively small size are formed through disintegration, since disintegration is performed in the insulation liquid, the toner particles can be prevented from coarsening due to aggregation. Further, the insulation liquid can be preserved in the concavo-convexes of the surfaces of the toner particles inherent in the liquid fine particles (dispersoid). As a result, dispersibility of the toner particles can be increased.

Further, in the invention, since the toner particles are obtained by disintegrating the associated particles, fine powder (particles each having an extremely smaller size than the particles each having a target size) can be prevented from occurring, compared with a known milling method or a wet milling method. As a result, the charging property of the resultant liquid developer and the like can be effectively prevented from being degraded.

Moreover, in a case where associated particles each having a comparatively small size are prepared, the associated particles are dispersed in the insulation liquid as the toner particles without disintegrating, thereby obtaining a liquid developer, can be considered. In this case, however, when the associated particles are dried, since the particles have a small size, aggregation is likely to occur, and a variation in size between the toner particles occurs.

Further, upon the disintegration, preferably, in a state where the dispersant is preferably added to the insulation liquid, the disintegration of the associated particles is performed. Accordingly, since the dispersant is stuck to the surface of the associated particle, dispersibility of the associated particle increases, and viscosity of the mixture of the associated particles and the insulation liquid is reduced. For this reason, the associated particles can be further efficiently disintegrated, and dispersibility of the resultant toner particles in the insulation liquid can be increased. Further, since the disintegration is performed in a state where the dispersant is added, even though the surface area of the associated particle is increased due to the disintegration, viscosity of the liquid developer can be maintained in an appropriate range.

Usually, if the dispersant is added to the liquid developer, electrical resistance of the liquid developer is lowered due to the dispersant dissolved and dispersed in the insulation liquid. However, if the dispersant is added upon the disintegration, the dispersant can be stuck to the surface of the toner particle, and thus the amount of the dispersant dissolved and dispersed in the insulation liquid in the resultant liquid developer can be made small. For this reason, electrical resistance of the liquid developer can be prevented from being lowered due to the dispersant. As a result, the resultant liquid developer has an excellent charging property, and a narrow particle size distribution. Further, the toner particles each having a sufficiently small size can be stably dispersed in the liquid developer. According to the invention, such a liquid developer can be efficiently manufactured.

In contrast, when, in view of the adjustment of viscosity, the dispersant is added to and simply mixed with the liquid developer after disintegration or without disintegrating, it may be difficult to increase electrical resistance of the liquid developer. That is, when the dispersant is added to and mixed with the liquid developer, a physical force for bringing the toner particles into contact with the dispersant may be lacking, and thus the dispersant may not be appropriately stuck to the toner particles.

Further, in a case of the dispersant is added, preferably, when electrical resistance of the liquid developer at a room temperature (20° C.) is A [Ωcm] and electrical resistance of the insulation liquid is B [Ωcm], the disintegration of the associated particles is performed to satisfy to the relationship $0.04 \leqq A/B \leqq 0.3$. Accordingly, electrical resistance of the liquid developer can be prevented from being lowered, and a liquid developer in which the toner particles each having a sufficiently small size are stably dispersed can be obtained. More specifically, if the associated particles are disintegrated with appropriate energy such that electrical resistance of the liquid developer and the electrical resistance of the insulation liquid satisfy the above-described relationship, the dispersant can be appropriately stuck to the toner particles, and the size of the dispersant dissolved and dispersed in the insulation liquid can be made small. In addition, if the disintegration is performed, while appropriate energy is applied to the associated particles, so as to satisfy the above-described relationship, the particle size of the resultant toner particle can be made sufficiently small, and the particle size distribution can be made narrow. For this reason, the liquid developer can have an excellent charging property, and upon image forming, thin spot and density irregularity can be prevented from occurring. Further, since the liquid developer has an excellent charging property, excellent developability and transfer property, and a high image density are realized, and a vivid toner image is obtained. Further, since the toner particles each having a small particle size and having a narrow particle size distribution are obtained, resolution of the toner image can be increased. Electrical resistance of the liquid developer A [Ωcm] and electrical resistance of the insulation liquid B [Ωcm] preferably satisfy the above-described relationship, more preferably, the relationship $0.07 \leqq A/B \leqq 0.25$, and still more preferably, the relationship $0.08 \leqq A/B \leqq 0.2$. Therefore, the above-described effects can be further markedly obtained.

The dispersant that can be used for the disintegration is not particularly limited. Examples of the dispersant include, for example, polyvinyl alcohol, carboxymethyl cellulose, polyethylene glycol, polycarboxylic acid and salts thereof, polyacrylate metal salts (for example, sodium salt), polymethacrylate metal salts (for example, sodium salt), polyglycerine fatty acid ester, polyurethane derivatives, sorbitan fatty acid ester, polyoxyethylene alkyl ether, alkyl ether type nonionic surfactants, sorbitan derivative nonionic surfactants, polymaleate metal salts (for example, sodium salt), acrylate-maleate copolymer metal salts (for example, sodium salt), polystyrene sulfonate metal salts (for example, sodium salt), polymer dispersants, such as polyamine aliphatic polycondensates, viscous mineral, silica, tricalcium phosphate, tristearate metal salts (for example, aluminum salt), distearate acid metal salts (for example, aluminum salt, and barium salt), stearate metal salts (for example, calcium salt, lead salt, and zinc salt), linolenate metal salt (for example, cobalt salt, manganese salt, lead salt, and zinc salt), octanoate metal salts (for example, aluminum salt, calcium salt, and cobalt salt), oleate metal salts (for example, calcium salt, cobalt salt), palmitate metal salts (for example, zinc salt), alkylbenzene sulfonate metal salts (for example, sodium salt), naphthenate metal salts (for example, calcium salt, cobalt salt, manganese salt, lead salt, and zinc salt), resinate metal salts (for example, calcium salt, cobalt salt, manganese lead salt, and zinc salt), glycerine fatty acid esters, which can be used alone or in combination of two or more of them.

Among these dispersants, the polymer dispersant is preferably used. The polymer dispersant can be appropriately stuck to the associated particles upon the disintegration, and also to the toner particles in the resultant liquid developer. For this reason, the toner particles in the resultant liquid developer have excellent dispersibility. Further, in the resultant liquid developer, the dispersant dissolved and dispersed in the insulation liquid can be made small. For this reason, the liquid developer has a particular excellent charging property. In addition, upon the disintegration, viscosity of the mixture of the associated particles and the insulation liquid can be maintained low, and thus the disintegration can be performed with high efficiently.

When plant oil described below or a compound containing fatty acids, such as fatty acid ester, is used as the insulation liquid of the liquid developer, a compound that has a structure having many three-way branch points, from which linear side changes are branched off, on the main chain (comb-like structure) is preferably used as the polymer dispersant. Accordingly, the polymer dispersant has excellent compatibility with the insulation liquid. For this reason, the toner particles to which the polymer dispersant having a comb-like structure has excellent dispersibility in the insulation liquid.

The weight-average molecular weight of the polymer dispersant is preferably in a range of 1000 to 100000, and more preferably, 5000 to 80000. Accordingly, the above-described effects can be markedly obtained.

The dispersant is preferably a basic dispersant. Accordingly, the dispersant can be appropriately stuck to the associated particles and the toner particles.

As the polymer dispersant satisfying the above-described conditions, for example, polyglycerine fatty acid esters and polyamine aliphatic polycondensates can be exemplified. Among these, when the polyaminealiphatic condensate is used, the above-described effects can be markedly obtained. Moreover, as the polyamine aliphatic polycondensate, for example, SOLSPERSE (product name by Lubrizol Japan Ltd.) can be exemplified.

The content of the dispersant in the resultant liquid developer is preferably in a range of 0.10 to 3.0 wt %, more preferably, 0.15 to 1.8 wt %, and still more preferably, 0.20 to 1.5 wt %. Accordingly, the toner particles in the liquid developer can have excellent dispersibility, viscosity of the liquid developer can be appropriately maintained, and the liquid developer can have an excellent charging property. Further, upon the disintegration, the particle size of the toner particle can be made sufficiently small. In contrast, if the content of the dispersant is less than the lower limit described above, viscosity upon the disintegration may be excessively increased depending on the insulation liquid to be used, and the toner particles each having a sufficiently small particle size may not be obtained. Further, the toner particles in the resultant liquid developer may not have excellent dispersibility. In addition, viscosity of the resultant liquid developer may be excessively increased, and in a liquid developing device P1 described below, the liquid developer may not be uniformly supplied to a coating roller P12. Meanwhile, if the content of the dispersant exceeds the upper limit described above, electrical resistance of the liquid developer may be excessively lowered depending on the dispersant to be used, and an excellent charging property may not be realized. For this reason, upon image forming, problems, such as thin spot and density irregularity, may arise in a toner image.

Example of the insulation liquid include, for example, ISOPAR E, ISOPAR G, ISOPAR H, ISOPAR L (ISOPAR; product name by Exxon Mobil), SHELLSOL 70, SHELLSOL 71 (SHELLSOL; product name by Shell Oil); Amsco OMS, Amsco 460 solvent (Amsco; product name by Spirit Co., Ltd.), mineral oils, such as low-viscosity/high-viscosity liquid paraffin (Wako Pure Chemical Industries Co., Ltd.), plant oils, such as linseed oil, and soybean oil, fatty acid esters, such as fatty acid monoester and medium-chain fatty acid ester, octane, isooctane, decane, isodecane, decaline, nonane, dodecane, isododecane, cyclohexane, cyclooctane, cyclodecane, benzene, toluene, xylene, and mesitylene, which can be used alone or in combination of two or more of them.

Among these, when fatty acid monoester is used as the insulation liquid, the following effects can be obtained. That is, since fatty acid monoester has comparatively low viscosity, it easily enters between the fine particles (dispersoid) forming the associated particles, and thus the associated particles can be appropriately disintegrated. Further, since fatty acid monoester is an environment-friendly component, leakage of the insulation liquid outside an image forming apparatus, or an affect of the insulation liquid on the environment due to the disposal of the used liquid developer can be reduced. As a result, an environment-friendly liquid developer can be provided. Further, in particular, when unsaturated fatty acid monoester having an unsaturated bond among the fatty acid monoesters is used, since unsaturated fatty acid monoester is subject to an oxidization polymerization reaction upon fixing, the toner particles can be further solidly fixed to the recording medium.

When heat or pressure is applied to the resultant liquid developer during a fixing process, fatty acid monoester enters the toner particles (resin material), and plasticizes the toner particles (plasticizer effect). With the plasticizer effect, for example, when a paper is used as the recording medium, the toner particles easily enter a gap between paper fabrics, an anchor effect is present, and a fixing property between the paper and the toner particles is improved. In addition, when the insulation liquid contains an unsaturated fatty acid component, the insulation liquid is cured by heat or the like upon fixing in a state where the toner particles are contained therein. Accordingly, with the anchor effect between the recording medium and the cured liquid developer, an excellent fixing property of the toner particles to the recording medium can be realized. Further, with the plasticizer effect, since the toner particles can be molten and fixed to the recording medium at a comparatively low temperature, it can also be appropriately applied for image forming at low temperature and high speed.

When the insulation liquid that is used for the disintegration is fatty acid monoester, the surface of associated particle is plasticized by fatty acid monoester, and thus the dispersant is easily stuck to the surface of the associated particle. For this reason, in the resultant liquid developer, the amount of the dispersant dissolved and dispersed in the insulation liquid can be made small, and the liquid developer having an excellent charging property can be realized. Further, fatty acid monoester can be stuck to the toner particles during the disintegration and plasticize the resin component, the toner particles after the disintegration have high average circularity described below.

When the disintegration is performed using fatty acid monoester, if the polymer dispersant exists, the polymer dispersant can appropriately exist on the surface of the toner particle (can be stuck thereto). Since the polymer dispersant has high compatibility with fatty acid monoester, when a liquid containing a different insulation liquid is mixed after the disintegration, fatty acid monoester can be further effectively maintained in the vicinity of the surface of the toner particle. For this reason, upon the disintegration, the plasticizer effect of fatty acid monoester can further effectively exhibit, and thus the dispersant can be further effectively stuck to the toner particles. Accordingly, the polymer dispersant and fatty acid monoester react with each other in a synergistic manner, and thus the polymer dispersant and fatty acid monoester are appropriately stuck to the surface of the toner particle. As a result, the toner particles in the liquid developer can have excellent dispersibility and an excellent fixing property. In addition, since the plasticizer effect effectively exhibits, the toner particles after the disintegration have high average circularity.

Further, since the polymer dispersant is stuck to the surface of the plasticized particle and rarely released therefrom, and the liquid developer has an excellent preservation property.

Among the above-described materials, when medium-chain fatty acid ester is used as the insulation liquid, the following effects are obtained. That is, medium-chain fatty acid ester has small interfacial tension to the resin material forming the toner particles, and small viscosity. Accordingly, it can further effectively enter the fine particles (dispersoid) forming the associated particles, and thus the associated particles can be further effectively disintegrated. Further, medium-chain fatty acid ester has small interfacial tension to the resin material forming the toner particles, and simultaneously it has high compatibility with the toner particles (the resin material forming the toner particles). Accordingly, the toner particles can have high dispersibility. In addition, medium-chain fatty acid ester has high electrical insulation, and exhibits high performance as the insulation liquid. Further, since medium-chain fatty acid ester is an environment-friendly component, leakage of the insulation liquid outside the image forming apparatus or an affect of the insulation liquid on the environment due to the disposal of the used liquid developer can be reduced. As a result, an environment-friendly liquid developer can be provided.

While medium-chain fatty acid ester can have any shape, it is preferably ester of glycerine and medium-chain fatty acid (hereinafter, also referred to as 'medium-chain fatty acid triglyceride'). If the above-described ester is formed in the insulation liquid, the liquid developer can have excellent preservation property and long-term stability.

Moreover, in this specification, medium-chain fatty acid forming medium-chain fatty acid ester indicates one having the number of carbon atoms of 8 to 10.

Among the above-described materials, when low-viscosity paraffin oil is used as the insulation liquid, since low-viscosity paraffin oil has low viscosity, it can easily enter the fine particles (dispersoid) forming the associated particles, and thus the associated particles can be appropriately disintegrated.

An apparatus that is used for the disintegration is not particularly limited. For example, a ball mill, such as vibrating ball mill, a rotating ball mill, or a planetary ball mill, a cutting mill, such as a universal cutting mill, a rotor speed mill, a bead mill, such as a vertical bead mill, a horizontal bead mill, an attritor, an SC mill, an MSC mill, or a fine mill, a jet mill, a classifier mill, a disk mill, an impact coal pulverizer, or an automatic mortar can be used. Among these, the bead mill or the ball mill is preferably used. With this apparatus, the associated particles can be disintegrate with a further appropriate shear force, and thus the toner particles having a narrow particle size distribution and each having a sufficiently small size can be efficiently obtained. Further, fatty acid monoester and the dispersant can be appropriately can be stuck to the surface of the toner particle. For this reason, in the resultant liquid developer, the toner particles that have a narrow particle size distribution and have a small particle size are stably dispersed, and an excellent charging property is realized.

Moreover, although a case where the disintegration of the associated particles is performed with the total amount of the insulation liquid forming the resultant liquid developer has been described in the foregoing description, the disintegration may be performed using a portion of the insulation liquid. Accordingly, the disintegration can be further efficiently performed.

When the disintegration is performed using a portion of the insulation liquid, the same liquid as the liquid used for the disintegration may be added as the insulation liquid after the disintegration, or a liquid different from the liquid used for the disintegration may be added to the insulation liquid after the disintegration. In the latter case, the properties of the resultant liquid developer, such as viscosity and the like, can be easily adjusted.

Electrical resistance of the insulation liquid described above at a room temperature (20° C.) is preferably $1\times10^{9}$ Ωcm or more, more preferably, $1\times10^{11}$ Ωcm or more, and still more preferably, $1\times10^{12}$ Ωcm or more.

A dielectric constant of the insulation liquid is preferably 3.5 or less.

Further, viscosity of the insulation liquid that is used for the disintegration is preferably 1000 mPa·s or less, and more preferably, 1 to 300 mPa·s. Accordingly, the disintegration of the associated particles can be further efficiently performed. Further, in this specification, viscosity is measured at 25° C. using a vibrating viscometer based on JIS Z8809.

Further, interfacial tension of the insulation liquid used for the disintegration with respect to the resin material forming the toner particles is preferably 35 mN/m or less, and more preferably, 32 mN/m or less. Accordingly, dispersibility of the toner particles can be further effectively improved, and the preservation property of the liquid developer can be effectively improved.

Further, electrical resistance of the liquid developer at a room temperature (20° C.) is preferably $1\times10^{9}$ Ωcm or more, more preferably, $1\times10^{11}$ Ωcm or more, and still more preferably, $1\times10^{13}$ Ωcm or more.

The average particle size of the toner particles in the resultant liquid developer is preferably in a range of 0.1 to 5 μm, more preferably, 0.1 to 4 μm, and still more preferably, 0.5 to 3 μm. If the average particle size of the toner particles falls within the above-described range, a variation in characteristic between the toner particles can be made small, and the liquid developer can has high reliability as a whole. In addition, resolution of an image to be formed by the liquid developer (toner) can be sufficiently increased.

The standard deviation in particle size between the toner particles forming the liquid developer is preferably 1.0 μm or less, more preferably, in a range of 0.1 to 1.0 μm, and still more preferably, 0.1 to 0.8 μm. Accordingly, the variation in characteristic between the toner particles can be made small, and reliability of the liquid developer can be further improved as a whole.

The content of the toner particles in the liquid developer is preferably in a range of 10 to 60 wt %, and more preferably, 20 to 50 wt %. Accordingly, when the dispersant is used in the disintegration process, upon preservation of the resultant toner, the toner particles can be reliably prevented from coming into contact with each other to release the dispersant, and the liquid developer can have an excellent charging property. In addition, the liquid developer can have appropriate viscosity, and the conditions of heating and the like upon fixing can be settled.

Further, when the content of the dispersant in the liquid developer is C [wt %] and the content of the toner particles is D [wt %], the relationship $0.006 \leqq C/D \leqq 0.12$, and more preferably, the relationship $0.01 \leqq C/D \leqq 0.10$ is satisfied. Accordingly, an appropriate amount of the dispersant can be stuck to the toner particle. Therefore, dispersibility of the toner particles can be particularly increased, and the dispersant dispersed and dissolved in the insulation liquid can be made small. For this reason, the liquid developer can have appropriate viscosity, and high electrical resistance can be realized.

Further, viscosity of the liquid developer is preferably in a range of 20 to 300 mPa·s, and more preferably, 30 to 250 mPa·s. If viscosity of the liquid developer falls within the above-described range, dispersibility of the toner particles can be further increased, and in a liquid developing device P1, the liquid developer can be further uniformly supplied to a coating roller P12. In addition, the liquid developer can be further effectively prevented from dripping from the coating roller P12 or the like.

Next, a preferred embodiment of an image forming apparatus according to the invention, to which the above-described liquid developer is applied, will be described. An image forming apparatus according to the embodiment of the invention includes a liquid developing device that forms a toner image on the recording medium, and a fixing device that fixes the formed toner image to the recording medium.

FIG. 1 shows an example of a contact type liquid developing device that constitutes the image forming apparatus according to an embodiment of the invention. The liquid developing device P1 has a developer container (liquid developer storage unit) P11 that stores a liquid developer, a cylindrical photoreceptor (developing unit) P2 that develops an image (toner image), a developing unit P10 that supplies the liquid developer from the developer container P11 to the photoreceptor P2, and an intermediate transfer roller (transfer unit) P18 that transfers the image developed on the recording medium by the photoreceptor P2 so as to form a transfer image (toner image).

The liquid developing device P1 has a drum of the cylindrical photoreceptor P2. The surface of the drum is uniformly charged by a charger P3 formed of epichlorohydrin rubber, and then exposure P4 is performed thereon by a laser diode according to information to be recorded, thereby forming an electrostatic latent image.

The developing unit P10 has a coating roller P12, a portion of which is immersed into the developer container P11, and a developing roller P13. The coating roller P12 is, for example, a gravure roller formed of a metal, such as stainless steel, and rotates while facing the developing roller P13. Further, a liquid developer coated layer P14 is formed on the surface of the coating roller P12, and the thickness thereof is maintained constant by a metering blade P15.

Then, the liquid developer is transferred from the coating roller P12 to the developing roller P13. The developing roller P13 has a roller core member P16 formed of a metal, such as stainless steel, and a low-hardness silicone rubber layer provided on the roller core member P16. On the surface of the silicone rubber layer, a resin layer formed of conductive PFA (polytetrafluoroethylene-perfluorovinyl ether copolymer) is formed. The developing roller P13 is adapted to rotate at the same speed as the photoreceptor P2 to transfer the liquid developer to a latent image section. A part of the liquid developer remaining on the developing roller P13 after the transfer to the photoreceptor P2 is removed by the a developing roller cleaning blade P17 and then collected in the developer container P11.

After the image (toner image) is transferred from the photoreceptor P2 to the intermediate transfer roller P18, the photoreceptor is discharged with discharging light P21, and a toner that has not been transferred and remains on the photoreceptor is removed by a cleaning blade P22 formed of urethane rubber or the like.

In a similar manner, the toner that is not transferred and remains on the intermediate transfer roller P18 after the toner image has been transferred to a recording medium F5 from the intermediate transfer roller P18, such as a paper, is removed by a cleaning blade P23 formed of urethane rubber or the like.

The image (toner image) formed on the photoreceptor P2 is transferred to the intermediate transfer roller P18. Then, a transfer current is supplied to a secondary transfer roller P19, and the toner image transferred on the intermediate roller P18 is transferred onto the recording medium F5 that passes between the intermediate transfer roller P18 and the secondary transfer roller P19. Thereafter, the toner image (transfer image) on the recording medium F5 is fixed thereto using a fixing unit described below.

Figure 2:
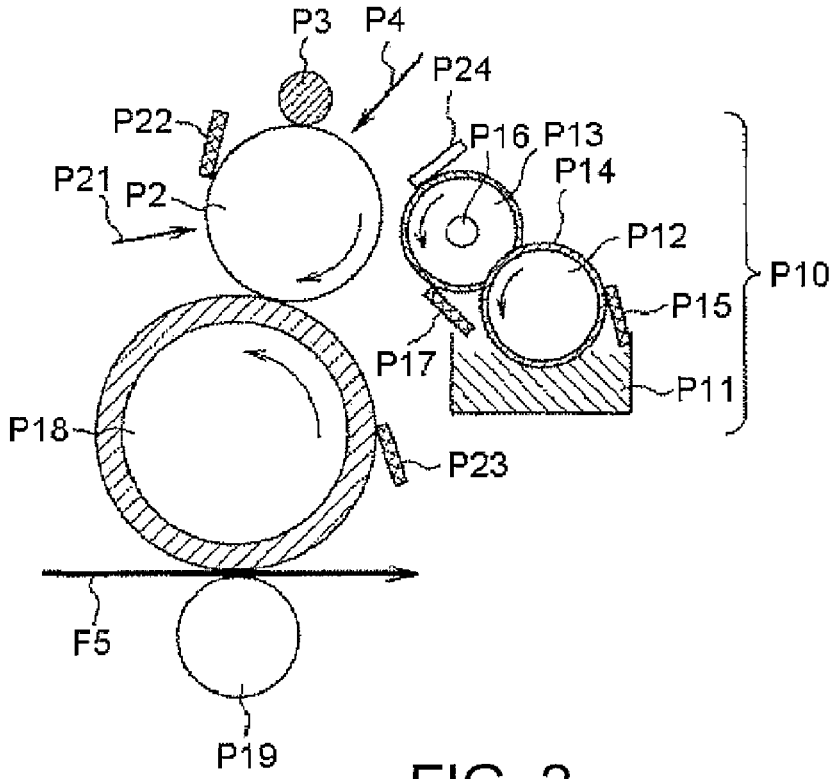
FIG. 2 is a cross-sectional view showing an example of a non-contact type liquid developing device that constitutes an image forming apparatus according to an embodiment of the invention.

FIG. 2 shows an example of a non-contact type liquid developing device that constitutes an image forming apparatus according to the embodiment of the invention. In the non-contact type, a developing roller P13 is provided with a charging blade P24 that is formed of a phosphor-bronze plate having a thickness of 0.5 mm. The charging blade P24 has a function of causing a layer of the liquid developer to be frictionally charged. Further, since the coating roller P12 is a gravure roller, a layer of a developer having concavo-convexes that correspond to concavo-convexes on the surface of the gravure roller is formed on the developing roller P13. The charging blade 24 also has a function of uniformizing the concavo-convexes formed on the developing roller P13. The orientation of the charging blade 24 is either of a counter direction or a trail direction with respect to the rotation direction of the developing roller. Further, the charging blade 24 may be in a form of a roller not a blade.

Preferably, between the developing roller P13 and the photoreceptor P2, there is formed a gap whose width is 200 μm to 800 μm, and an AC voltage having 500 to 3000 Vpp and a frequency of 50 to 3000 Hz which is superimposed on a DC voltage of 200 to 800 V is applied across the developing roller P13 and the photoreceptor P2. Other parts are the same as those of the liquid developing device described with reference to FIG. 1.

Moreover, the description has been made with respect to image formation by the embodiments shown in FIGS. 1 and 2 in which the liquid developer of one color is used. However, it goes without saying that, when an image is formed using color toners of a plurality of colors, a color image can be formed using a plurality of developing units corresponding to the respective colors to form images of the respective colors.

Figure 3:
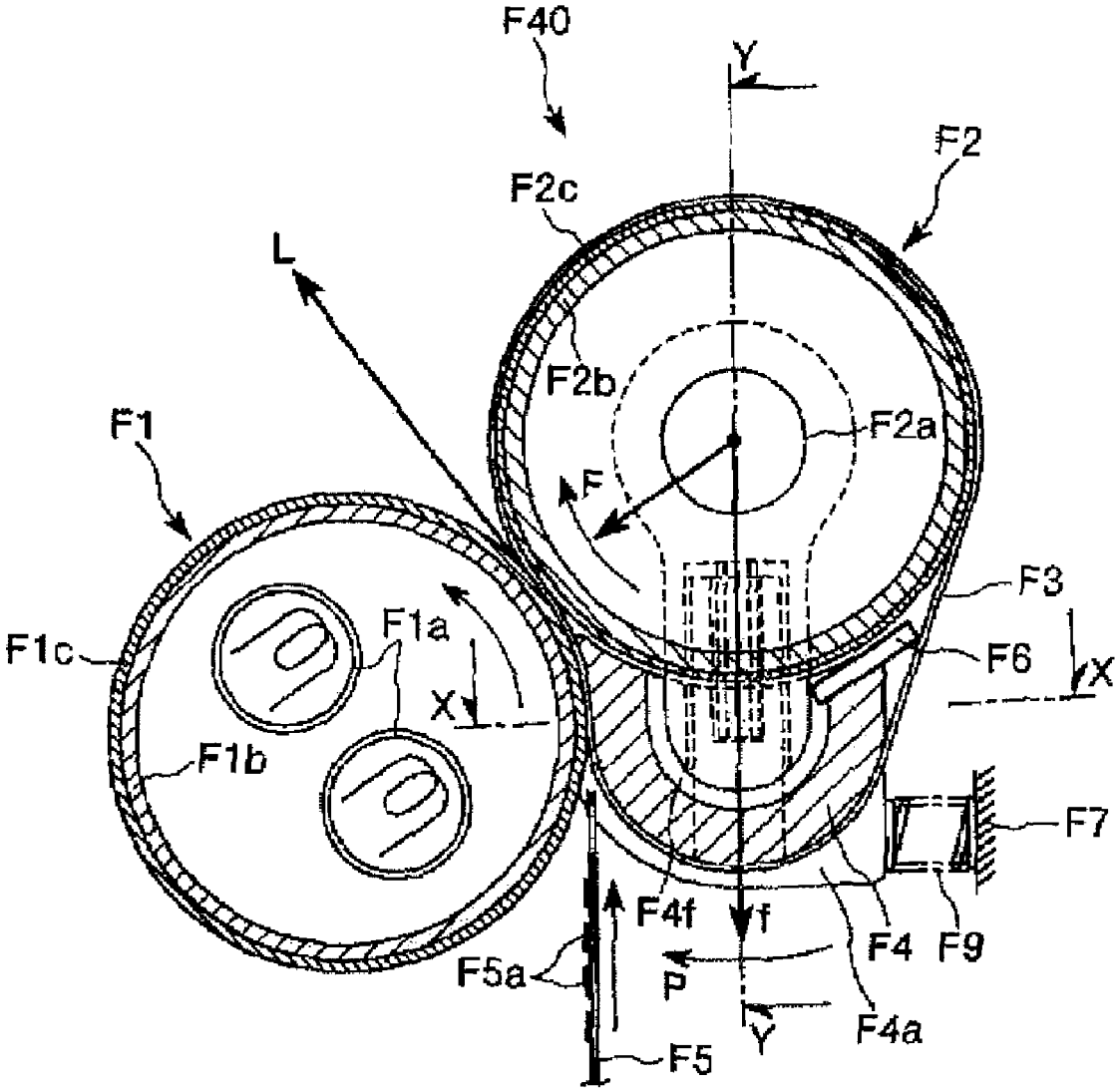
FIG. 3 is a cross-sectional view showing an example of a fixing device that constitutes an image forming apparatus according to an embodiment of the invention.

FIG. 3 is a cross-sectional view showing an example of a fixing device that constitutes the image forming apparatus according to the embodiment of the invention.

As shown in FIG. 3, a fixing device (fixing unit) F40 has a heat fixing roller F1, a pressure roller F2, a heat resistant belt F3, a belt tension member F4, a cleaning member F6, a frame F7, and a spring F9.

The heat fixing roller (fixing roller) F1 has a roller base F1*b* that is formed of a pipe member, an elastic body F1*c* that covers the periphery of the roller base F1*b*, and a tubular halogen lamp F1*a* that is provided in the: roller base F1*b* to function as a heat source. The heat fixing roller F1 is rotatable in a counterclockwise direction as indicated by an arrow in the drawing.

The pressure roller F2 has a roller base F2*b* that is formed of a pipe member, and an elastic body F2*c* that covers the periphery of the roller base F2*b*. The pressure roller F2 is rotatable in a clockwise direction as indicated by an arrow in the drawing.

A PFA layer is provided on the surface layer of the elastic layer F1*c* of the heat fixing roller F1. Accordingly, even though the thicknesses of the elastic bodies F1*c* and F2*c* are different from each other, both elastic bodies F1*c* and F2*c* are elastically deformed substantially uniformly, thereby forming a so-called horizontal nip. Further, there is no difference between the peripheral velocity of the heat fixing roller F1 and the feed speed of the heat resistant belt F3 or the recording medium F5. For this reason, it is possible to perform extremely stable image fixation.

Further, two tubular halogen lamps F1*a* and F1*a* that form the heat source are provided inside the heat fixing roller F1. The tubular halogen lamps F1*a* and F1*a* are provided with heating elements, respectively, which are arranged at different positions. With this arrangement, by selectively lighting up any one or both of the halogen lamps F1*a* and F1*a*, it is possible to easily perform a temperature control under different conditions, such as a case where a wide recording medium is used or a narrow recording medium is used, or a case where a fixing nip portion where the heat resistant belt F3 winds around the heat fixing roller F1 is to be heated or a portion where the belt tension member F4 slidably comes into contact with the heat fixing roller F1 is to be heated.

The pressure roller F2 is disposed to face the heat fixing roller F1, and is adapted to apply a pressure to the recording medium F5, on which an unfixed toner image (transfer image) is formed, through the heat resistant belt F3 described below. With the application of the pressure, the insulation liquid can efficiently enter the recording medium F5. As a result, the toner image F5*a* can be further solidly fixed onto the recording medium F5.

The pressure roller F2 has the roller base F2*b* that is formed of a pipe member, and the elastic body F2*c* that covers the periphery of the roller base F2*b*. The pressure roller F2 is rotatable in a clockwise direction as indicated by an arrow in the drawing.

The elastic body F1*c* of the heat fixing roller F1 and the elastic body F2*c* of the pressure roller F2 are elastically deformed substantially uniformly, thereby forming a so-called horizontal nip. Further, there is no difference between the peripheral velocity of the heat fixing roller F1 and the feed speed of the heat resistant belt F3 or the recording medium F5. For this reason, it is possible to perform extremely stable image fixation.

The heat resistant belt F3 is a ring-shaped endless belt, and it winds around the peripheries of the pressure roller F2 and the belt tension member F4 such that it can be moved with being held between the heat fixing roller F1 and the pressure roller F2 in a pressed state.

The heat resistant belt F3 is formed of a seamless tube having a thickness of 0.03 mm or more. Further, the seamless tube has a two-layered structure in which its surface (a surface that comes into contact with the recording medium F5) is formed of PFA, and the opposite surface thereof (a surface that comes into contact with the pressure roller F2 and the belt tension member F4) is formed of polyimide. Moreover, the heat resistant belt F3 is not limited thereto, but it may be formed of other materials. Examples of the tubes formed of other materials include a metal tube, such as a stainless tube or a nickel electrocasting tube, a heat-resistance resin tube, such as a silicone tube, and the like.

The belt tension member F4 is disposed on an upstream side of the fixing nip portion between the heat fixing roller F1 and the pressure roller F2 in the feed direction of the recording medium F5. Further, the belt tension member F4 is pivotally disposed about a rotation shaft F2*a* of the pressure roller F2 in the direction of an arrow P.

The belt tension member F4 is configured such that the heat resistant belt F3 is extended with tension in the tangential direction of the heat fixing roller F1 in a state where the recording medium F5 does not pass through the fixing nip portion. When the fixing pressure is large at an initial position where the recording medium F5 enters the fixing nip portion, there may be a case where the recording medium F5 cannot enter the fixing nip portion smoothly and thus fixing is performed in a state where the tip portion of the recording medium F5 is folded. However, in this embodiment, the belt tension member F4 is provided such that the heat resistant belt F3 is extended with tension in the tangential direction of the heat fixing roller F1. Accordingly, it is possible to form an introduction portion for smoothly introducing the recording medium F5, such that the recording medium F5 can be introduced into the fixing nip portion in a stable manner.

The belt tension member F4 is a roughly semicircular belt sliding member that is fitted into the inside of the heat resistant belt F3 so as to apply tension f to the heat resistant belt F3 in cooperation with the pressure roller F2 (the heat resistant belt F3 slidably moves on the belt tension member F4). The belt tension member F4 is disposed at a position where the heat resistant belt F3 winds toward the heat fixing roller F1 over the pressure roller F2 over a tangential line L of the pressing portion between the heat fixing roller F1 and the pressure roller F2 to form a nip portion. A protruding wall F4*a* is formed on one end or both ends of the belt tension member F4*a* in the axial direction. The protruding wall F4*a* is provided to restrict the heat resistant belt F3 from being deviated off to the side by coming into contact therewith when the heat resistant belt F3 is deviated in any one side of the axial ends.

The spring F9 is provided between an end of the protruding wall F4*a* opposite to the heat fixing roller F1 and the frame, thereby slightly pressing the protruding wall F4*a* of the belt tension member F4 against the heat fixing roller F1. In such a manner, the belt tension member F4 is positioned with respect to the heat fixing roller F1 while slidably coming into contact with the heat fixing roller F1.

A position where the belt tension member F4 is slightly pressed against the heat fixing roller F1 becomes a nip initial position, and a position where the pressure roller F2 is pressed against the heat fixing roller F1 becomes a nip end position.

When the liquid developer contains fatty acid monoester, a linear pressure against the recording medium F5 at the nip end position, that is, a linear pressure of the pressure roller F2 against the recording medium F5 is preferably 500 g/cm or less, and more preferably, 300 g/cm or less. As such, even though a comparatively low linear pressure is applied, since the above-described liquid developer is applied, the toner particles can be solidly fixed onto the recording medium F5. Further, since a comparatively low linear pressure is used, driving power of the pressure roller F2 or the heat fixing roller F1 can be made small, and thus energy saving can be realized.

In the fixing device F40, the recording medium F5, on which an unfixed toner image F5*a* is formed using an image forming apparatus described below, enters the fixing nip portion from the nip initial position, passes between the heat resistant belt F3 and the heat fixing roller F1, and gets off from the nip end position. Then, the unfixed toner image F5*a* formed on the recording medium F5 is thermally fixed, and thereafter, the recording medium F5 is discharged in the tangential direction L of the pressingportion of the pressure roller F2 against the heat fixing roller F1.

The cleaning member F6 is disposed between the pressure roller F2 and the belt tension member F4.

The cleaning member F6 slidably comes into contact with the inner surface of the heat resistant belt F3 so as to clean foreign substances or wear debris on the inner surface of the heat resistant belt F3. Since the foreign substances or wear debris is cleaned in such a manner, the heat resistant belt F3 is refreshed, and the unstable factors on the frictional coefficients are eliminated. Further, the belt tension member F4 is provided with a concave portion F4*f*, in which the foreign substances or wear debris removed from the heat resistant belt F3 is collected.

Moreover, in order to stably drive the heat resistant belt F3 by the pressure roller F2 in a state where the heat resistant belt F3 winds around the pressure roller F2 and the belt tension member F4, the frictional coefficient between the pressure roller F2 and the heat resistant belt F3 is set to be larger than the frictional coefficient between the belt tension member F4 and the heat resistant belt F3. However, there may be a case where the frictional coefficients become unstable due to enter of foreign substances between the heat resistant belt F3 and the pressure roller F2 or between the heat resistant belt F3 and the belt tension member F4, or due to the abrasion of the contact portion between the heat resistant belt F3 and the pressure roller F2 or the belt tension member F4.

Accordingly, the winding angle of the heat resistant belt F3 with respect to the pressure roller F2 is set to be smaller than the winding angle of the heat resistant belt F3 with respect to the belt tension member F4, and the diameter of the belt tension member F4 is set to be smaller than the diameter of the pressure roller F2. With this configuration, the distance that the heat resistant belt F3 slides on the belt tension member F4 becomes short, such that unstable factors due to deterioration with the elapse of time or disturbance can be avoided. As a result, the heat resistant belt F3 can be driven with the pressure roller F2 in a stable manner.

When the liquid developer contains fatty acid monoester, a time (nip time) required until the toner particles pass through the fixing nip portion is preferably in a range of 0.02 to 0.2 seconds, and more preferably, 0.03 to 0.1 seconds. Even though the time required until the toner particles pass through the fixing nip portion is such short time, with the above-described liquid developer, the toner particles can be sufficiently fixed, and thus a printing speed can be further increased.

A fixing temperature when the unfixed toner image is fixed is preferably in a range of 80 to 200° C., and more preferably, 80 to 180° C. If the fixing temperature falls within the above-described range, when the liquid developer contains an unsaturated fatty acid component, the oxidization polymerization reaction (curing reaction) of the unsaturated fatty acid component can be further effectively advanced. As a result, the toner particles can be solidly fixed onto the recording medium.

When the image forming apparatus according to the embodiment of the invention including the liquid developing device and the fixing device described above is used, a high-resolution and vivid toner image can be obtained, without causing thin spot and irregularity.

Although the invention has been described on the basis of the preferred embodiment, the invention is not limited thereto.

For example, an image forming apparatus according to the invention is not limited to an image forming apparatus that includes the liquid developing device and the fixing device described above.

Although a case where the water-based emulsion is obtained and the associated particles are obtained by adding the electrolyte to the water-based emulsion has been described in the above-described embodiment, the invention is not limited thereto. For example, the associated particles may be prepared using an emulsion polymerization and association method that disperses a polymerization initiator of a colorant, a monomer, and a surfactant to a water-based liquid, prepares a water-based emulsion through emulsion polymerization, adds an electrolyte to the water-based emulsion, and performs association. Then, the resultant water-based emulsion is subject to spray drying, thereby obtaining the associated particles.

EXAMPLES

[1] Liquid Developer Preparation

Example 1

First, 80 parts by weight of polyester resin (softening temperature: 99° C.) and 20 parts by weight of a cyanogen-based pigment (pigment blue 15:3 manufactured by Dainichiseika Color & Chemicals Mfg. Co., Ltd.) as a colorant were prepared. These components were mixed using a 20 L type Henschel mixer to obtain a material for producing a toner.

Next, the material (mixture) was kneaded using a biaxial kneader-extruder. A kneaded material extruded from an extruding port of the biaxial kneader-extruder was cooled.

The kneaded material that had been cooled as described above was coarsely ground to be formed into powder having an average particle size of 1.0 mm or less. A hammer mill was used for coarse grounding of the kneaded material.

Next, 250 parts by weight of toluene was added to 100 parts by weight of the coarse kneaded material, and then it was subjected to a treatment using an ultrasound homogenizer (output: 400 μA) for one hour to obtain a solution in which polyester resin of the kneaded material is dissolved. Moreover, in the solution, the pigment was finely dispersed homogeneously.

Meanwhile, 1 part by weight of sodium-dodecyl benzene sulfonic acid as a dispersant and 700 parts by weight of ion-exchange water were homogeneously mixed to obtain a water-based liquid.

The water-based liquid was stirred with a homomixer (manufactured by PRIMIX Corporation) with the number of stirring being adjusted.

The above-described solution (the toluene solution of the kneaded material) was dropped in the water-based liquid in a stirred state, to thereby obtain a water-based emulsion in which a dispersoid having an average particle size of 0.5 μm was homogeneously dispersed. Moreover, the density of the solid content (dispersoid) in the resultant water-based emulsion was 35 wt %.

Next, 0.35 part by weight of a nonionic surfactant (product name 'Epan 450' manufactured by Dai-ichi Kogyo Seiyaku Co., Ltd.) was added to 100 parts by weight of the water-based emulsion under stirring.

Next, after the stirring speed had been adjusted and the temperature had been set to 30° C., 35 parts by weight of 3% aqueous ammonium sulfate solution was dropped in 100 parts by weight of the water-based emulsion, to thereby obtain an associated particle dispersion liquid in which associated particles were dispersed.

The associated particles were separated from the resultant associated particle dispersion liquid with a centrifugal separator, and then cleaning was performed. Thereafter, drying was performed with a vacuum drier, to thereby obtain the associated particles. The average particle size of the resultant associated particles was 5.2 μm.

Next, a 4 mm carbon chromium bead was put in a 500 mL vessel, and then 50 parts by weight of methyl caprylate (product name: 'PASTELL M-08' manufactured by Lion Co., Ltd.) and 5 parts by weight of polyamine aliphatic polycondensate (product name: 'SOLSPERSE 1120' manufactured by Lubrizol Japan Ltd.) as a dispersant were put in the vessel. Moreover, viscosity of methyl caprylate was 1.3 mPa·s, and interfacial tension to the resin material was 28 mN/m.

Next, 50 parts by weight of the resultant associated particles was put in the vessel and mixed with a ball mill for ten minutes. Therefore, 0.5 part by weight of magnesium stearate was put in the vessel as a charge controller, and disintegrated with a ball mill for 200 hours.

After the disintegration was finished, 150 parts by weight of medium-chain fatty acid triglyceride was put in the vessel and mixed. The mixture was performed with a ball mill for 24 hours while a 4 mm bead was put in the vessel, to thereby obtain a liquid developer.

In the resultant liquid developer, the average particle size of the toner particles was 1.3 μm, and standard deviation in the particle size between the toner particles was 0.50 μm.

Example 2

A liquid developer was prepared in the same manner as the example 1, except that soybean oil fatty acid methyl (manufactured by Nisshin Oillio Group, Ltd.), instead of methyl caprylate, was used as the insulation liquid used for the disintegration, and soybean oil (manufactured by Nisshin Oillio Group, Ltd.), instead of medium-chain fatty acid triglyceride, was used as the insulation liquid added after the disintegration. Moreover, viscosity of soybean oil fatty acid methyl was 6.5 mPa·s, and interfacial tension to the resin material was 31 mN/m.

Example 3

A liquid developer was prepared in the same manner as the example 1, except that low-viscosity paraffin oil (manufactured by Wako Pure Chemical Industries Co., Ltd.), instead of methyl caprylate, was used as the insulation liquid used for the disintegration, and high-viscosity liquid paraffin (manufactured by Wako Pure Chemical Industries Co., Ltd.), instead of medium-chain fatty acid triglyceride, was used as the insulation liquid added after the disintegration. Moreover, viscosity of low-viscosity paraffin oil was 10.0 mPa·s, and interfacial tension to the resin material was 32 mN/m,

Example 4

First, in the same manner as the example 1, the associated particles were prepared.

Next, a 1 mm carbon-chromium bead was put in a 200 mL vessel, and then 80 parts by weight of methyl caprylate (product name: 'PASTELL M-08' manufactured by Lion Co., Ltd.) and 0.5 part by weight of polyamine aliphatic polycondensate (product name: 'SOLSPERSE 11200' manufactured by Lubrizol Japan Ltd.) as the dispersant were put in the vessel.

Next, 20 parts by weight of the resultant associated particles was put in the vessel and mixed with a ball mill for 10 minutes. Thereafter, 0.5 parts by weight of magnesium stearate was put in the vessel as a charge controller and disintegrated with a ball mil for 200 hours, to thereby obtain a liquid developer.

In the resultant liquid developer, the average size of the toner particles was 1.3 μm, and the standard deviation in particle size between the toner particles was 0.48 μm.

Example 5

A liquid developer was prepared in the same manner as the example 1, except that epoxy resin (softening temperature: 80.5° C.) was used as the resin material.

Comparative Example 1

80 parts by weight of epoxy resin (softening temperature: 80.5° C.) and 20 parts by weight of phthalocyanine pigment as a colorant were kneaded at 100° C. exceeding the softening point of resin with a double-roll, and then coarsely ground at 1 to 10 mm square, to thereby obtain colored tips.

Next, the colored tips were ground with a pin mill while being cooled by liquid nitrogen, and then removed by a sieve of 150 μm mesh, to thereby obtain a pulverized material having an average particle size of 42 μm.

Next, 20 parts by weight of the pulverized material was mixed with 80 parts by weight of ion-exchange water, and then subjected to wet milling with an attritor (manufactured by Union Process Inc.). The average particle size of the resultant particles in water was 2.0 μm. Moreover, the measurement of the average particle size was performed using laser diffraction/scattering type particle size distribution analyzer (LA-920 manufactured by Horiba, Ltd.).

Next, 100 parts by weight of the resultant pulverized liquid was gradually dropped in 100 parts by weight of the insulation liquid with irradiation by an ultrasound homogenizer, to thereby obtain a mixed solution. Moreover, as the insulation liquid, a mixture of low-viscosity paraffin oil and 2 parts by weight of a surfactant (1,2-hydroxystearic acid methyl) was used.

Next, water was removed from the resultant mixed solution using an evaporator, to thereby obtain a liquid developer. Moreover, the removal of water was performed under the conditions of a treatment temperature 70° C. and a treatment pressure 10 kPa. The average particle size of the toner particles in the resultant liquid developer was 2.1 μm. The standard deviation in particle size between the toner particles was 0.85 μm.

Comparative Example 2

In the preparation of the water-based emulsion, the preparation conditions, such as the stirring speed and the like, and the additive amount and condition of the electrolyte (ammonium sulfate) were appropriately adjusted such that the average particle size of the associated particles in the associated particle dispersion liquid was 1.5 μm.

Next, the associated particles were separated from the associated particle dispersion liquid and then dried in the same manner as the example 1.

Next, 50 parts by weight of the resultant associated particles, 50 parts by weight of methyl caprylate, 150 parts by weight of medium-chain fatty acid triglyceride, and 5 parts by weight of polyamine aliphatic polycondensate as a dispersant were mixed, to thereby obtain a liquid developer. Moreover, in the resultant liquid developer, the average particle size of the toner particles was 1.8 μm, and the standard deviation in particle size between the toner particles was 0.96 μm.

In respect to the individual examples and the individual comparative examples, the preparation conditions of the liquid developers were shown in Table 1. Moreover, in Table 1, in the columns 'Insulation Liquid Used For Disintegration' of the comparative examples 1 and 2, the kinds of the used insulation liquid were described.

[2] Evaluation

The individual liquid developers obtained as described above were subjected to the following evaluation.

[2.1] Dispersion Stability Test 10 mL of the liquid developer obtained in each of the examples and the comparative examples was put in a centrifugal tube and under a centrifugal separator on the condition 1000 G and 10 minutes. Thereafter, the supernatant 200 μL was collected and diluted 100 times than the insulation liquid used in each of the examples and the comparative examples, to thereby obtain a sample.

The absorption wavelength of each sample was measured using a visible-ultraviolet spectrophotometer (V-570 manufactured by JASCO Corporation).

The evaluation was performed from the value of absorbance of an absorption band (685 nm) of a cyanogen-based pigment on the basis of the following four-step standard.

◎: Absorbance is more than 1.50 (no sedimentation is observed).

○: Absorbance is more than 1.00 but less than 1.50 (sedimentation is not almost observed).

Δ: Absorbance is more than 0.50 but less than 1.00 (sedimentation is observed).

×: Absorbance is less than 0.50 (sedimentation is remarkably observed and starts while it has been left).

[2.2] Preservation Property

The liquid developer obtained in each of the examples and the comparative examples was left for six months under the environment of temperature 15 to 25° C. Thereafter, the shape of the toner in the liquid developer was confirmed by a naked eye and evaluated on the basis of the following five-step standard.

TABLE 1

| | Resin Material | | Average Particle Size of Associated Particles | Insulation Liquid | | | | |
|---|---|---|---|---|---|---|---|---|
| | | | | Insulation Liquid Used for Disintegration | | | Insulation Liquid Added After Disintegration | |
| | Kind | Softening Temperature [° C.] | [μm] | Kind | Viscosity [mPa · s] | Interfacial Tension to Resin Material [mN/m] | Kind | Viscosity [mPa · s] |
| Example 1 | polyester resin | 99 | 5.2 | methyl caprylate | 1.3 | 28 | medium-chain fatty acid triglyceride | 20 |
| Example 2 | polyester resin | 99 | 5.2 | soybean oil fatty acid methyl | 6.5 | 31 | soybean oil | 66 |
| Example 3 | polyester resin | 99 | 5.2 | low-viscosity liquid paraffin | 10.0 | 32 | high-viscosity liquid paraffin | 200 |
| Example 4 | polyester resin | 99 | 5.2 | methyl caprylate | 1.3 | 28 | — | — |
| Example 5 | epoxy resin | 80.5 | 5.2 | methyl caprylate | 1.3 | 28 | medium-chain fatty acid triglyceride | 20 |
| Comparative Example 1 | epoxy resin | 80.5 | — | low-viscosity liquid paraffin | 10.0 | — | — | — |
| Comparative Example 2 | polyester resin | 99 | 1.5 | methyl caprylate/ medium-chain fatty acid triglyceride | 1.3/20.0 | — | — | — |

◎◎: Release and aggregation/sedimentation of toner particles are not observed at all.

◎: Release and aggregation/sedimentation of toner particles are not almost observed.

○: Release and aggregation/sedimentation of toner particles are observed a little, but this range does not matter as the liquid developer.

Δ: Release and aggregation/sedimentation of toner particles are distinctly observed.

×: Release and aggregation/sedimentation of toner particles are remarkably observed.

[2.3] Charging Property

The evaluation of the charging property was performed using 'Laser Zeta Electrometer' ELS-6000 manufactured by otsuka Denshi Co., Ltd. on the basis of the following four-step standard.

◎: Potential difference is more than +50 mV.

○: Potential difference is more than +45 mV but less than +50 mV.

Δ: Potential difference is more than +30 mV but less than +45 mV.

×: Potential difference is less than +30 mV.

The results are shown in Table 2 along with the average particle size of the toner particles based on the volume and the standard deviation in particle size.

TABLE 2

| | Standard | | Evaluation | | |
|---|---|---|---|---|---|
| | Average Particle Size [μm] | Deviation in Particle Size [μm] | Dispersion Stability | Preservation Property | Charging Property |
| Example 1 | 1.3 | 0.50 | ◎ | ◎◎ | ◎ |
| Example 2 | 1.2 | 0.43 | ◎ | ◎◎ | ◎ |
| Example 3 | 1.5 | 0.53 | ○ | ○ | ◎ |
| Example 4 | 1.3 | 0.48 | ◎ | ◎ | ◎ |
| Example 5 | 1.3 | 0.61 | ○ | ◎ | ◎ |
| Comparative Example 1 | 2.1 | 0.85 | x | x | Δ |
| Comparative Example 2 | 1.8 | 0.96 | Δ | Δ | Δ |

As will be apparent from Table 2, the liquid developer of the invention had excellent dispersion stability, preservation property, and charging property. In contrast, in case of the liquid developers of the comparative examples, satisfactory results were not obtained.

Further, when a liquid developer was prepared and evaluated in the same manner as described above, except that pigment red 122, pigment yellow 180, or carbon black (Printex L manufactured by Degussa Corporation), instead of the cyanogen-based pigment, was used as the colorant, the same results as described above were obtained.

[3] Liquid Developer Preparation

Example 6

Preparation of Liquid Constituting Insulation Liquid

As the insulation liquid, a liquid mainly containing unsaturated fatty acid glyceride and a liquid mainly containing unsaturated fatty acid methyl ester were prepared in the following manner.

First, coarse soybean oil was purified in the following manner, to thereby obtain a purified soybean oil.

Initially, as a medium, coarse soybean oil was coarsely purified using a low-temperature crystallization method using methanol, diethylether, petroleum ether, and acetone.

Next, 300 parts by volume of the purified coarse soybean oil (first coarsely purified oil) was put in a flask. Thereafter, 100 parts by volume of boiled water was poured into the flask, and then the flask was plugged.

Next, the flask was shaken such that coarse soybean oil (first coarsely refined oil) and boiled water were mixed.

Next, the flask had been left until the mixed solution in the flask was separated into three layers.

After it was confirmed that the mixed solution was completely separated, the flask was put in a freezer and left for 24 hours.

Subsequently, an unfrozen component in the mixed solution was taken out and put in a different flask.

The unfrozen component was again subjected to the same operation as described above. Then, an unfrozen component was taken out to obtain coarsely refined fatty oil (second coarsely refined oil).

Next, 100 parts by volume of the coarsely refined fatty oil (second coarsely refined oil) obtained as described above and 35 parts by volume of activated earth mainly containing hydrous silicic aluminum were mixed and stirred in a flask.

Next, the resultant mixture was left for 48 hours under a pressure (0.18 MPa) such that the activated earth was completely settled down.

Then, the precipitation was removed to thereby obtain refined soybean oil (hereinafter, simply referred to 'soybean oil'). Moreover, fatty acid glyceride mainly containing linoleic acid was contained in the soybean oil, and the amount of unsaturated fatty acid glyceride in the soybean oil was 98 wt %. Further, the linoleic acid component was 53 mol % in the entire fatty acid components.

Next, an ester interchange reaction between a portion of the soybean oil and methanol was performed, and glycerine generated by the above reaction was taken out, to thereby obtain a liquid mainly containing fatty acid monoester. In addition, the liquid was refined, to thereby obtain soybean oil fatty acid methyl in which the content of fatty acid monoester was 99.9 wt % or more. The fatty acid monoester obtained as described above mainly contains unsaturated fatty acid monoester, such as methyl oleate, methyl linoleate, or a-methyl linoleate, and saturated fatty acid monoester, such as methyl palmitate or methyl stearate.

Further, coarse high-oleic rape oil was refined with the same operation as the soybean oil, to thereby obtain refined high-oleic rape oil (hereinafter, simply referred to as 'high-oleic rape oil'). Moreover, fatty acid glyceride mainly containing oleic acid was contained in the high-oleic rape oil, and unsaturated fatty acid glyceride in the high-oleic rape oil was 98 wt %. In addition, the oleic acid component and the linoleic acid component were 58 mol % and 24 mol % in the entire fatty acid components, respectively.

Next, an ester interchange reaction between a portion of the high-oleic rape oil and methanol was performed, and glycerine generated by the above reaction was taken out, to thereby obtain a liquid mainly containing fatty acid monoester. In addition, the liquid was refined, to thereby obtain rape oil fatty acid methyl in which the content of fatty acid monoester was 99.9 wt % or more.

Colorant Master Solution Preparation

Further, a mixture (mass ratio 50:50) of polyester resin (softening temperature: 125° C., Tg: 60.5° C., and acid value: 7.7) and a cyanogen-based pigment (pigment blue 15:3 manufactured by Dainichiseika Color & Chemicals Mfg. Co., Ltd.) as a colorant was prepared. The components were mixed using a 20 L type Henschel mixer, to thereby obtain a material for producing a toner.

Next, the material (mixture) was kneaded using a biaxial kneader-extruder. A kneaded material extruded from an extruding port of the biaxial kneader-extruder was cooled.

The kneaded material that had been cooled as described above was coarsely ground to be formed into powder having an average particle size of 1.0 mm or less. A hammer mill was used for coarse grounding of the kneaded material.

Methyl ethyl ketone was added such that the solid content in the resultant powder of the kneaded material reaches 30 mass %. Then, wet dispersion was performed using Eiger Motormill (M-1000 manufactured by Eiger Machinery Inc., U.S.) to thereby prepare a colorant master solution.

Resin Liquid Preparation 140 parts by weight of methyl ethyl ketone and 60 parts by weight of polyester resin were added to 133 parts by weight of the colorant master solution, and mixed with Eiger Motormill (M-1000 manufactured by Eiger Machinery Inc., U.S.), to thereby produce a resin liquid. Moreover, in this solution, a pigment was homogeneously and finely dispersed.

Water-Based Emulsion Preparation (Water-Based Emulsion Preparation Process)

500 parts by weight of the resin liquid and 45.5 parts by weight of methyl ethyl ketone were put in a 2 L cylindrical separable flask having a 'Max blend' stirring wing, such the solid content of the resin liquid was set to 55%.

Next, 41.7 parts by weight of 1 normal ammonia water (a molar equivalent ratio with respect to the total amount of a carboxyl group of polyester resin was 1.1) was added to the resin liquid in the flask, and then sufficiently stirred with a three-one motor (manufactured by Shinto Scientific Co., Ltd.) at a revolution number 210 rpm of the stirring wing (the peripheral velocity of the stirring wing: 0.71 m/s). Thereafter, 133 parts by weight of deionized water was added under stirring. The temperature of the liquid in the flask was adjusted to 25° C., and 133 parts by weight of deionized water was dropped in the resin liquid under stirring to cause a phase inversion emulsification, thereby obtaining a water-based emulsion in which the dispersoid containing the resin material was dispersed.

Associated Particle Manufacturing with Association (Associated Particle Forming Process)

Next, while keeping stirring the inside of the flask, 285 parts by weight of deionized water was added to the water-based emulsion, such that the total amount of 1 normal ammonia water and water reached 593 parts by weight. Next, 2.6 parts by weight of EMAL O (manufactured by Kao Corporation) as an anionic emulsifier was diluted by 30 parts by weight of deionized water and then added to the water-based emulsion.

Thereafter, while the temperature of the water-based emulsion was maintained at 25° C., at the revolution number of 150 rpm (the peripheral velocity of the stirring wing: 0.54 m/s), 300 parts by weight of a 3.5% aqueous ammonium sulfate solution was dropped, such that the particle size of an associate of the dispersoid was set to 3.5 μm. After dropping, stirring was continued until the particle size of the associate of the dispersoid was grown to 5.2 μm and then the association operation was finished.

After an organic solvent was distilled from the obtained associate dispersion liquid under a reduced pressure, and then cleaning and anhydration were repeatedly performed. Therefore, drying was performed to thereby obtain associated particles. Some of the associated particles were dissolved in methyl ethyl ketone, and an extraction operation was performed. Then, the analysis was performed with a gas chromatography (GC-17A+QP-5000, manufactured by Shimadzu Corporation) equipped with a mass spectrometer, on which a pyrolyzer (PYR-4A manufactured by Shimadzu Corporation) is mounted. As a result, EMAL O (manufactured by Kao Corporation) as the anionic emulsifier was not detected. Moreover, the average particle size in each of the examples and the comparative examples is an average particle size based on the volume, and the average particle size and the particle size distribution of the particles were measured with a Mastersizer 2000 particle size analyzer (Malvern Instruments Ltd.).

Liquid Developer Preparation (Disintegration Process)

40 parts by weight of the associated particles and 80 parts by weight of soybean oil fatty acid methyl obtained by the above-described method, 1 part by weight of polyamine aliphatic polycondensate (product name: 'SOLSPERSE 1394' manufactured by Lubrizol Japan Ltd.) as the dispersant, and 0.5 part by weight of aluminum stearate (manufactured by NOF Corporation) as the charging controller were put in a zirconia pot (inner volume 500 ml), and a steel bead (a bead diameter: 1 mm) was put in the zirconia pot to reach a volume filling ratio 30%. Then, disintegration was performed using a rotating ball mill (ANZ51S manufactured by AS ONE Corporation) at a rotation speed 210 rpm for 48 hours. After the disintegration has been finished, 120 parts by weight of high-oleic rape oil was put in the pot and then mixed. The mixture was performed by stirring with the volume filling ratio 30% at the rotation speed 210 rpm for 24 hours using the same ball mill and steel bead (the bead diameter: 1 mm). Accordingly, a liquid developer was obtained.

In the resultant liquid developer, the average particle size of the toner particles was 1.3 μm, and the standard deviation in particle size between the toner particles was 0.47 μm. Further, electrical resistance A of the liquid developer was $3.2\times10^{12}$ Ωcm, electrical resistance B of the mixture of the used insulation liquid was $2.6\times10^{13}$ Ωcm, and B/A was 0.12. Moreover, in this specification, electrical resistance of the liquid was measured with a universal electrometer (MMAII-17B manufactured by Kawaguchi Electric Works Co., Ltd.), to which an electrode for liquid (LP-05 manufactured by Kawaguchi Electric Works Co., Ltd.) and a shield box (P-618 manufactured by Kawaguchi Electric Works Co., Ltd.) are attached, at a room temperature (20° C.)

Examples 7 to 9

A liquid developer was prepared in the same manner as the example 6, except that an insulation liquid in Table 3 was used as an insulation liquid used for disintegration and an insulation liquid added after disintegration.

Example 10

Coarse high-oleic safflower oil was refined with the same operation as the soybean oil, to thereby obtain refined high-oleic safflower oil (hereinafter, simply referred to as 'high-oleic safflower oil'). Moreover, fatty acid glyceride mainly containing oleic acid was contained in the high-oleic safflower oil, and the amount of unsaturated fatty acid glyceride in the high-oleic safflower oil was 98 wt %. In addition, the oleic acid component and the linoleic acid component were 76 mol % and 16 mol % in the entire fatty acid components, respectively.

Hereinafter, a liquid developer was prepared in the same manner as the example 6, except that 120 parts by weight of high-oleic safflower oil, instead of 120 parts by weight of high-oleic rape oil, was used as the insulation liquid to be added after disintegration.

Example 11

Coarse high-oleic sunflower oil was refined with the same operation as the soybean oil, to thereby obtain refined high-oleic sunflower oil (hereinafter, simply referred to as 'high-oleic sunflower oil'). Moreover, fatty acid glyceride mainly containing oleic acid was contained in the high-oleic sunflower oil, and the amount of unsaturated fatty acid glyceride in the high-oleic sunflower oil was 98 wt %. Further, the oleic acid component and the linoleic acid component were 80 mol % and 11 mol % in the entire fatty acid components, respectively.

Hereinafter, a liquid developer was prepared in the same manner as the example 6, except that 120 parts by weight of high-oleic sunflower oil, instead of 120 parts by weight of high-oleic rape oil, was used as the insulation liquid to be used after disintegration.

Example 12

A liquid developer was prepared in the same manner as the example 6, except that 80 parts by weight of soybean oil, instead of 80 parts by weight of soybean oil fatty acid methyl, was used as the insulation liquid to be used for disintegration.

Examples 13 to 16

A liquid developer was prepared in the same manner as the example 6, except that a polyamine aliphatic polymer was added as the dispersant used for disintegration, as described in Table 3.

Example 17

A liquid developer was prepared in the same manner as the example 6, except that epoxy resin (softening temperature: 128° C.) was used as the resin material.

Examples 18 to 20

A liquid developer was prepared in the same manner as the example 6, except that a dispersant described in Table 3 was used as the dispersant used for disintegration.

Comparative Example 3

80 parts by weight of polyester resin (softening temperature: 125° C., Tg: 60.5° C., and acid value: 7.7) and 20 parts by weight of a cyanogen-based pigment (pigment blue 15:3 manufactured by Dainichiseika Color & Chemicals Mfg. Co., Ltd.) as the colorant were kneaded at 135° C. exceeding the softening point of resin with a double-roll, and then coarsely ground at 1 to 10 mm square, to thereby obtain colored tips.

Next, the colored tips were ground with a pin mill while being cooled by liquid nitrogen, and then removed by a sieve of 150 μm mesh, to thereby obtain a pulverized material having an average particle size of 42 μm.

Next, 40 parts by weight of the pulverized material, 1.0 part by weight of polyamine aliphatic polymer as the dispersant, and 80 parts by weight of soybean oil fatty acid methyl were mixed, and then subjected to wet milling with an attritor (manufactured by Union Process Inc.). Next, 121 parts by weight of the pulverized liquid was gradually dropped in 120.5 parts by weight of a liquid mainly containing high-oleic rape oil with irradiation by an ultrasound homogenizer and a mixed solution was obtained. Moreover, as the above-described liquid, a liquid in which 0.5 parts by weight of aluminum stearate as the charging controller had been added to high-oleic rape oil was used. In the resultant liquid developer, the average particle size of the toner particles was 2.0 μm, and the standard deviation in particle size between the toner particles was 0.83 μm.

Comparative Example 4

In the preparation of the water-based emulsion, the preparation conditions, such as the stirring speed and the like, or the additive amount and condition of the electrolyte (ammonium sulfate) were appropriately adjusted such that the average particle size of the associated particles in the associated particle dispersion liquid was 1.5 μm.

Next, the associated particles was separated from the associated particles dispersion liquid in the same manner as the example 6 and then dried.

Next, 40 parts by weight of the resultant associated particles, 80 parts by weight of soybean oil fatty acid methyl, 120 parts by weight of high-oleic rape oil, 1.0 part by weight of polyamine aliphatic polycondensate as the dispersant, and 0.5 part by weight of aluminum stearate as the charging controller were mixed, to thereby obtain a liquid developer. Moreover, in the resultant liquid developer, the average particle size of the toner particles was 1.7 μm, and the standard deviation in particle size between the toner particles was 0.93 μm.

In respect to the individual examples and the individual comparative example described above, the preparation conditions of the liquid developers were shown in Table 3. Moreover, in Table 3, in the column 'Insulation Liquid Used For Disintegration' of the comparative example 3, the kind of the insulation liquid used for the disintegration was described. Further, in the column 'Insulation Liquid Added After Disintegration' of the comparative example 4, the kind of the used insulation liquid was described. In addition, in Table 3, 'HO' represents 'high-oleic'. The weight-average molecular weights of the dispersants used for disintegration and milling described in Table 3 were within a range of 5000 to 80000.

TABLE 3

| | Resin Material | | Average Particle Size of | Insulation Liquid Used for Disintegration (Milling) | | | Insulation Liquid Added After Disintegration | | | | | |
|---|---|---|---|---|---|---|---|---|---|---|---|---|
| | Kind | Softening Temperature [° C.] | Associated Particles μm] | Kind | Viscosity [mPa · s] | Interfacial Tension to Resin Material [mN/m] | Kind | Viscosity [mPa · s] | Dispersant Used for Disintegration (Milling) | Content of Dispersant in Liquid Developer C [wt %] | Content of Toner Particles in Liquid Developer D [wt %] | C/D |
| Example 6 | polyester resin | 125 | 5.2 | soybean oil fatty acid methyl | 6.5 | 31.5 | HO rape oil | 75 | polyamine aliphatic polycondensate | 0.42 | 16.6 | 0.025 |

TABLE 3-continued

| | Resin Material | | Average Particle Size of Associated Particles | Insulation Liquid Used for Disintegration (Milling) | | | Insulation Liquid Added After Disintegration | | | | Content of Toner Particles in Liquid | |
|---|---|---|---|---|---|---|---|---|---|---|---|---|
| | Kind | Softening Temperature [° C.] | µm] | Kind | Viscosity [mPa · s] | Interfacial Tension to Resin Material [mN/m] | Kind | Viscosity [mPa · s] | Dispersant Used for Disintegration (Milling) | Content of Dispersant in Liquid Developer C [wt %] | Developer D [wt %] | C/D |
| Example 7 | polyester resin | 125 | 5.2 | soybean oil fatty acid methyl | 6.5 | 31.5 | soybean oil | 66 | polyamine aliphatic polycondensate | 0.42 | 16.6 | 0.025 |
| Example 8 | polyester resin | 125 | 5.2 | rape oil fatty acid methyl | 6.6 | 31.3 | soybean oil | 66 | polyamine aliphatic polycondensate | 0.42 | 16.6 | 0.025 |
| Example 9 | polyester resin | 125 | 5.2 | rape oil fatty acid methyl | 6.6 | 31.3 | HO rape oil | 75 | polyamine aliphatic polycondensate | 0.42 | 16.6 | 0.025 |
| Example 10 | polyester resin | 125 | 5.2 | rape oil fatty acid methyl | 6.6 | 31.3 | HO safflower oil | 83 | polyamine aliphatic polycondensate | 0.42 | 16.6 | 0.025 |
| Example 11 | polyester resin | 125 | 5.2 | soybean oil fatty acid methyl | 6.5 | 31.5 | HO safflower oil | 73 | polyamine aliphatic polycondensate | 0.42 | 16.6 | 0.025 |
| Example 12 | polyester resin | 125 | 5.2 | soybean oil | 6.6 | 33.3 | soybean oil | 66 | polyamine aliphatic polycondensate | 0.42 | 16.6 | 0.025 |
| Example 13 | polyester resin | 125 | 5.2 | soybean oil fatty acid methyl | 6.5 | 31.5 | HO rape oil | 75 | polyamine aliphatic polycondensate | 0.08 | 16.6 | 0.005 |
| Example 14 | polyester resin | 125 | 5.2 | soybean oil fatty acid methyl | 6.5 | 31.5 | HO rape oil | 75 | polyamine aliphatic polycondensate | 0.13 | 16.6 | 0.008 |
| Example 15 | polyester resin | 125 | 5.2 | soybean oil fatty acid methyl | 6.5 | 31.5 | HO rape oil | 75 | polyamine aliphatic polycondensate | 1.67 | 16.4 | 0.102 |
| Example 16 | polyester resin | 125 | 5.2 | soybean oil fatty acid methyl | 6.5 | 31.5 | HO rape oil | 75 | polyamine aliphatic polycondensate | 2.08 | 16.3 | 0.128 |
| Example 17 | polyester resin | 128 | 5.2 | soybean oil fatty acid methyl | 6.5 | 31.5 | HO rape oil | 75 | polyamine aliphatic polycondensate | 0.42 | 16.6 | 0.025 |
| Example 18 | polyester resin | 125 | 5.2 | soybean oil fatty acid methyl | 6.5 | 31.5 | HO rape oil | 75 | sorbitan fatty acid ester | 0.42 | 16.6 | 0.025 |
| Example 19 | polyester resin | 125 | 5.2 | soybean oil fatty acid methyl | 6.5 | 31.5 | HO rape oil | 75 | polyglycerol fatty acid ester | 0.42 | 16.6 | 0.025 |
| Example 20 | polyester resin | 125 | 5.2 | soybean oil fatty acid methyl | 6.5 | 31.5 | HO rape oil | 75 | sorbitan derivative nonionic surfactant | 0.42 | 16.6 | 0.025 |
| Comparative Example 3 | polyester resin | 128 | — | soybean oil fatty acid methyl | 6.5 | 31.5 | HO rape oil | 75 | polyamine aliphatic polycondensate | 0.42 | 16.6 | 0.025 |
| Comparative Example 4 | polyester resin | 125 | 1.5 | — | — | — | HO rape oil<br>soybean oil fatty acid methyl | 75<br>6.6 | polyamine aliphatic polycondensate | 0.42 | 16.6 | 0.025 |

[4] Evaluation

The individual liquid developers obtained as described above were subjected to the following evaluation.

[4.1] Dispersion Stability Test 10 mL of the liquid developer obtained in each of the examples and the comparative examples was put in a centrifugal tube and under a centrifugal separator on the condition 1100 G and 10 minutes. Thereafter, the supernatant 200 μL was collected and diluted 100 times than the insulation liquid used in each of the examples and the comparative examples, to thereby obtain a sample.

The absorption wavelength of each sample was measured using a visible-ultraviolet spectrophotometer (V-570 manufactured by JASCO Corporation).

The evaluation was performed from the value of absorbance of an absorption band (685 nm) of a cyanogen-based pigment on the basis of the following four-step standard.

◎: Absorbance is more than 1.50 (sedimentation is not observed at all).

○: Absorbance is more than 1.00 but less than 1.50 (sedimentation is not almost observed).

Δ: Absorbance is more than 0.50 but less than 1.00 (sedimentation is observed).

×: Absorbance is less than 0.50 (sedimentation is remarkably observed and starts while it has been left).

[4.2] Preservation Property

The liquid developer obtained in each of the examples and the comparative examples was left for eight months under the environment of temperature 15 to 25° C. Thereafter, the shape of the toner in the liquid developer was confirmed by a naked eye and evaluated on the basis of the following five-step standard.

◎◎: Release and aggregation/sedimentation of toner particles are not observed at all.

◎: Release and aggregation/sedimentation of toner particles are not almost observed.

○: Release and aggregation/sedimentation of toner particles are observed a little, but this range does not matter as the liquid developer.

Δ: Release and aggregation/sedimentation of toner particles are distinctly observed.

×: Release and aggregation/sedimentation of toner particles are remarkably observed.

[4.3] Charging Property

The evaluation of the charging property was performed using 'Laser Zeta Electrometer' ELS-6000 manufactured by Otsuka Denshi Co., Ltd. on the basis of the following four-step standard.

◎: Potential difference is more than +100 mV.

○: Potential difference is more than +50 mV but less than +100 mV.

Δ: Potential difference is more than +10 mV but less than +50 mV.

×: Potential difference is less than +10 mV.

The results are shown in Table 4 along with the properties of the liquid developer and electrical resistance of the used insulation liquid.

TABLE 4

| | Liquid Developer | | | | | | | | |
|---|---|---|---|---|---|---|---|---|---|
| | Toner Particle | | | | Electrical | | Evaluation | | |
| | Average Particle Size [μm] | Standard Deviation in Particle Size [μm] | Viscosity of Liquid Developer [mPa · s] | Electrical Resistance A [Ωcm] × $10^{12}$ | Resistance of Insulation Liquid B [Ωcm] × $10^{13}$ | A/B | Dispersion Stability | Preservation Property | Charging Property |
| Example 6 | 1.3 | 0.47 | 250 | 3.2 | 2.6 | 0.12 | ◎ | ◎◎ | ◎ |
| Example 7 | 1.3 | 0.48 | 260 | 2.5 | 2.0 | 0.13 | ◎ | ◎◎ | ◎ |
| Example 8 | 1.3 | 0.47 | 260 | 1.3 | 1.5 | 0.09 | ◎ | ◎◎ | ◎ |
| Example 9 | 1.3 | 0.46 | 250 | 2.2 | 2.1 | 0.10 | ◎ | ◎◎ | ◎ |
| Example 10 | 1.3 | 0.48 | 270 | 2.8 | 2.6 | 0.11 | ◎ | ◎◎ | ◎ |
| Example 11 | 1.3 | 0.48 | 260 | 3.0 | 2.9 | 0.10 | ◎ | ◎◎ | ◎ |
| Example 12 | 1.4 | 0.50 | 450 | 1.8 | 1.6 | 0.11 | ◎ | ◎◎ | ○ |
| Example 13 | 1.8 | 0.58 | 500 | 3.5 | 2.6 | 0.13 | ○ | ◎ | ◎ |
| Example 14 | 1.5 | 0.49 | 280 | 3.4 | 2.6 | 0.13 | ◎ | ◎◎ | ◎ |
| Example 15 | 1.3 | 0.47 | 200 | 1.8 | 2.6 | 0.07 | ◎ | ◎◎ | ◎ |
| Example 16 | 1.2 | 0.46 | 190 | 1.2 | 2.6 | 0.05 | ◎ | ◎◎ | ○ |
| Example 17 | 1.7 | 0.61 | 250 | 1.4 | 2.6 | 0.05 | ○ | ◎ | ○ |
| Example 18 | 1.4 | 0.50 | 300 | 1.8 | 2.6 | 0.07 | ◎ | ◎◎ | ◎ |
| Example 19 | 1.4 | 0.51 | 320 | 2.2 | 2.6 | 0.08 | ◎ | ◎◎ | ◎ |
| Example 20 | 1.6 | 0.54 | 430 | 1.4 | 2.6 | 0.05 | ○ | ◎ | ○ |
| Comparative Example 3 | 2.0 | 0.83 | 460 | 0.2 | 2.6 | 0.008 | Δ | x | x |
| Comparative Example 4 | 1.7 | 0.93 | 240 | 0.19 | 2.6 | 0.007 | Δ | Δ | x |

As will be apparent from Table 4, the liquid developer of the invention had excellent dispersion stability, preservation property, and charging property. In contrast, in case of the liquid developers of the comparative examples, satisfactory results were not obtained.

Further, when image forming had been performed using the image forming apparatus of FIG. 1, the fixing device of FIG. 3, and the liquid developer of the invention, a vivid and high-definition toner image with the resolution 2400 dpi was obtained without causing thin spot and irregularity.

In addition, when a liquid developer was prepared and evaluated in the same manner as described above, except that pigment red 122, pigment yellow 180, or carbon black (Printex L manufactured by Degussa Corporation), instead of the cyanogen-based pigment, was used as the colorant, the same results as described above were obtained.

The entire disclosure of Japanese Patent Application Nos: 2006-49230, filed Feb. 24, 2006 and 2006-284317, filed Oct. 18, 2006 are expressly incorporated by reference herein.

What is claimed is:

1. A method of manufacturing a liquid developer, the method comprising:

forming a water-based emulsion by dispersing a dispersoid mainly containing a resin material in a water-based liquid;

forming associated particles having an average particle size of 1~10 μm by adding an electrolyte to the water-based emulsion and associating the dispersoid having an average particle size of 0.01~3 μm in the water-based emulsion;

obtaining the associated particles by drying the dispersoid;

mixing the associated particles with a first insulation liquid;

disintegrating the associated particles in the first insulation liquid so as to obtain toner particles having an average particle size of 1~5 μm; and adding a second insulation liquid that is different from the first insulation liquid.

2. The method according to claim 1, wherein, when electrical resistance of the liquid developer is A [Ωcm] and electrical resistance of the insulation liquid is B [Ωcm], the relationship $0.04 \leqq A/B \leqq 0.3$ is satisfied.

3. The method according to claim 2, wherein, the content of the dispersant in the liquid developer is 0.10 to 3.0 wt %.

4. The method according to claim 3, wherein the dispersant is a polymer dispersant.

5. The method according to claim 3, wherein, when the content of the dispersant in the liquid developer is C [wt %] and the content of toner particles is D [wt %], the relationship $0.006 \leqq C/D \leqq 0.12$ is satisfied.

6. The method according to claim 1, wherein the first insulation liquid used for disintegration contains fatty acid monoester.

7. The method according to claim 1, wherein the first insulation liquid used for disintegration contains fatty acid ester, wherein said fatty acid ester has 8 to 10 carbon atoms.

8. The method according to claim 7, wherein the first insulation liquid is ester of medium-chain fatty acid and glycerine.

9. The method according to claim 1, wherein the insulation liquid used for disintegration contains paraffin oil, wherein said paraffin oil has a viscosity of 10.0 mPa·s or less.

10. The method according to claim 1, wherein viscosity of the insulation liquid used for disintegration is 1000 mPa s or less.

11. The method according to claim 1, wherein interfacial tension of the insulation liquid used for disintegration with respect to the resin material is 35 mN/m or less.

12. The method according to claim 1, wherein the resin material is polyester resin.

13. A liquid developer that is manufactured by a manufacturing method including:

forming a water-based emulsion by dispersing a dispersoid mainly containing a resin material in a water-based liquid;

forming associated particles having an average particle size of 1~10 μm by adding an electrolyte to the water-based emulsion and associating the dispersoid having an average particle size of 0.01~3 μm in the water-based emulsion;

obtaining the associated particles by drying the dispersoid;

mixing the associated particles with a first insulation liquid;

disintegrating the associated particles in the first insulation liquid so as to obtain toner particles having an average particle size of 1~10 μm; and adding a second insulation liquid that is different from the first insulation liquid.

14. An image forming apparatus comprising:

a liquid developer storage unit that stores a liquid developer;

a developing unit that develops using the liquid developer supplied from the liquid developer storage unit;

a transfer unit that transfers an image formed on the developing unit to a recording medium so as to form a transfer image on the recording medium; and a fixing unit that fixes the transfer image formed on the recording medium onto the recording medium, wherein the liquid developer is manufactured by a manufacturing method that includes:

forming a water-based emulsion by dispersing a dispersoid mainly containing a resin material in a water-based liquid;

forming associated particles having an average particle size of 1~10 μm by adding an electrolyte to the water-based emulsion and associating the dispersoid having an average particle size of 0.01~3 μm in the water-based emulsion;

obtaining the associated particles by drying the dispersoid;

mixing the associated particles with a first insulation liquid;

disintegrating the associated particles in the first insulation liquid so as to obtain toner particles having an average particle size of 1~10 μmμm; and adding a second insulation liquid that is different from the first insulation liquid.

* * * * *